US007275810B2

(12) United States Patent
Shinada et al.

(10) Patent No.: US 7,275,810 B2
(45) Date of Patent: Oct. 2, 2007

(54) INK-JET PRINTING APPARATUS AND INK CARTRIDGE THEREFOR

(75) Inventors: Satoshi Shinada, Nagano (JP); Fujio Akahane, Nagano (JP); Minoru Usui, Nagano (JP); Takao Kobayashi, Nagano (JP); Makoto Matsuzaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 174 days.

(21) Appl. No.: 10/121,414

(22) Filed: Apr. 12, 2002

(65) Prior Publication Data

US 2003/0058296 A1 Mar. 27, 2003

Related U.S. Application Data

(60) Division of application No. 09/484,458, filed on Jan. 18, 2000, now Pat. No. 6,502,917, which is a continuation-in-part of application No. PCT/JP99/02579, filed on May 18, 1999.

(30) Foreign Application Priority Data

| | | |
|---|---|---|
| May 18, 1998 | (JP) | 10-151882 |
| May 18, 1998 | (JP) | 10-151883 |
| Jun. 26, 1998 | (JP) | 10-180519 |
| Sep. 21, 1998 | (JP) | 10-266109 |
| Oct. 23, 1998 | (JP) | 10-301782 |
| Mar. 24, 1999 | (JP) | 11-78843 |

(51) Int. Cl.
*B41J 2/14* (2006.01)
*B41J 2/16* (2006.01)

(52) U.S. Cl. ..... 347/50; 347/86

(58) Field of Classification Search ..... 347/50, 347/85–87, 19, 12, 7, 11, 23, 5
See application file for complete search history.

(56) References Cited

U.S. PATENT DOCUMENTS

| | | | | |
|---|---|---|---|---|
| 4,279,519 | A | 7/1981 | Shiurila | |
| 4,500,895 | A | 2/1985 | Buck et al. | |
| 4,629,164 | A | 12/1986 | Sommerville | 239/69 |
| 4,633,274 | A | 12/1986 | Matsuda | |
| 4,780,095 | A | 10/1988 | Classon et al. | 439/637 |
| 4,806,103 | A | 2/1989 | Kniese et al. | |

(Continued)

FOREIGN PATENT DOCUMENTS

| | | |
|---|---|---|
| AU | 712 509 | 8/1997 |

(Continued)

OTHER PUBLICATIONS

U.S. Appl. No. 09/318,268, filed May 1999, Matsumoto et al.

(Continued)

*Primary Examiner*—Julian D. Huffman
(74) *Attorney, Agent, or Firm*—Stroock & Stroock & Lavan LLP

(57) ABSTRACT

An ink jet type printing apparatus in which an ink supply needle is located near one side in a direction perpendicular to the reciprocated directions of a carriage, a circuit board is mounted on a wall of an ink cartridge in the vicinity of the side on which an ink supply port is formed and plural contacts for connecting to external control means are formed on the exposed surface of the circuit board.

60 Claims, 24 Drawing Sheets

U.S. PATENT DOCUMENTS

| | | | | |
|---|---|---|---|---|
| 4,926,196 | A | 5/1990 | Mizoguchi et al. | |
| 4,929,963 | A | 5/1990 | Balazar | |
| 4,961,088 | A | 10/1990 | Gilliland et al. | 355/206 |
| 4,990,938 | A | 2/1991 | Brandon et al. | 347/37 |
| 4,999,652 | A | 3/1991 | Chan | |
| 5,049,898 | A | 9/1991 | Arthur et al. | 346/1.1 |
| 5,137,379 | A | 8/1992 | Ukai et al. | 400/121 |
| 5,138,344 | A | 8/1992 | Ujita | 346/140 R |
| 5,187,498 | A | 2/1993 | Burger | |
| 5,208,610 | A | 5/1993 | Su et al. | |
| 5,245,361 | A | 9/1993 | Kashimura et al. | 347/86 |
| 5,289,211 | A | 2/1994 | Morandotti et al. | |
| 5,343,869 | A | 9/1994 | Pross et al. | |
| 5,359,357 | A | 10/1994 | Takagi et al. | 347/49 |
| 5,363,134 | A | 11/1994 | Barbehenn et al. | |
| 5,365,312 | A | 11/1994 | Hillmann et al. | |
| 5,411,343 | A | 5/1995 | Childers | |
| 5,414,452 | A | 5/1995 | Accatino et al. | 347/7 |
| 5,442,386 | A | 8/1995 | Childers | 347/50 |
| 5,467,116 | A | 11/1995 | Nakamura et al. | 347/50 |
| 5,469,201 | A | 11/1995 | Erickson et al. | |
| D365,596 | S | 12/1995 | Miyazawa et al. | D18/56 |
| 5,491,540 | A | 2/1996 | Hirst | 355/200 |
| 5,497,178 | A | 3/1996 | DeFosse et al. | |
| D369,383 | S | 4/1996 | Miyazawa et al. | D18/56 |
| 5,506,611 | A | 4/1996 | Ujita et al. | 347/86 |
| 5,528,269 | A | 6/1996 | Drogo et al. | 347/19 |
| 5,590,510 | A | 1/1997 | Mochizuki et al. | |
| 5,610,635 | A | 3/1997 | Murray et al. | 347/7 |
| 5,640,186 | A | 6/1997 | Swanson et al. | 347/86 |
| 5,646,660 | A | 7/1997 | Murray | 347/59 |
| 5,691,753 | A | 11/1997 | Hilton | 347/85 |
| 5,696,541 | A | 12/1997 | Akahane et al. | 347/8 |
| 5,699,091 | A | 12/1997 | Bullock et al. | 347/19 |
| 5,706,040 | A | 1/1998 | Reid et al. | 347/87 |
| 5,748,210 | A | 5/1998 | Watanabe et al. | 347/50 |
| 5,751,320 | A | 5/1998 | Scheffelin et al. | 347/85 |
| 5,788,388 | A | 8/1998 | Cowger et al. | 400/703 |
| 5,812,156 | A | 9/1998 | Bullock et al. | 347/19 |
| 5,835,817 | A | 11/1998 | Bullock et al. | 399/25 |
| 5,861,897 | A | 1/1999 | Ide et al. | |
| 5,949,459 | A | 9/1999 | Gasvoda et al. | 347/86 |
| 5,975,677 | A | 11/1999 | Marler et al. | 347/40 |
| 6,000,773 | A | 12/1999 | Murray et al. | |
| 6,000,788 | A | 12/1999 | Iida | |
| 6,011,937 | A | 1/2000 | Chaussade et al. | |
| 6,017,118 | A | 1/2000 | Gasvoda et al. | 347/86 |
| 6,019,449 | A | 2/2000 | Bullock et al. | 347/19 |
| 6,019,461 | A | 2/2000 | Yoshimura et al. | 347/86 |
| 6,039,430 | A | 3/2000 | Helterline et al. | 347/19 |
| 6,065,824 | A | 5/2000 | Bullock et al. | 347/19 |
| 6,074,042 | A | 6/2000 | Gasvoda et al. | 347/50 |
| 6,089,687 | A | 7/2000 | Helterline | |
| 6,102,517 | A | 8/2000 | Kobayashi et al. | |
| 6,109,723 | A | 8/2000 | Castle et al. | 347/19 |
| 6,126,265 | A * | 10/2000 | Childers et al. | 347/23 |
| 6,130,695 | A | 10/2000 | Childers et al. | |
| 6,155,678 | A | 12/2000 | Komplin et al. | |
| 6,168,262 | B1 | 1/2001 | Clark et al. | 347/50 |
| 6,170,939 | B1 | 1/2001 | Ujita et al. | |
| 6,170,940 | B1 | 1/2001 | Shinada et al. | 347/86 |
| 6,196,670 | B1 | 3/2001 | Saruta | |
| 6,209,980 | B1 | 4/2001 | Kobayashi et al. | |
| 6,227,643 | B1 | 5/2001 | Purcell et al. | |
| 6,286,949 | B1 | 9/2001 | Lewis et al. | |
| 6,290,321 | B1 | 9/2001 | Murray et al. | |
| 6,312,088 | B1 | 11/2001 | Seino | |
| 6,361,138 | B1 | 3/2002 | Seino et al. | |
| 6,371,586 | B1 | 4/2002 | Saruta | |
| 6,375,298 | B2 | 4/2002 | Purcell et al. | 347/19 |
| 6,416,152 | B1 | 7/2002 | Matsuzaki et al. | 347/19 |
| 6,428,154 | B1 | 8/2002 | Kamiyama et al. | 347/86 |
| 6,435,676 | B1 | 8/2002 | Murray et al. | |
| 6,447,090 | B1 | 9/2002 | Saruta | 347/19 |
| 6,631,967 | B1 * | 10/2003 | Saruta | 347/19 |
| 2001/0007458 | A1 | 7/2001 | Purcell et al. | |
| 2002/0015067 | A1 | 2/2002 | Studholme et al. | |

FOREIGN PATENT DOCUMENTS

| | | | | |
|---|---|---|---|---|
| CA | 1252218 | | 4/1989 | |
| CA | 2101478 | C | 2/1994 | |
| CA | 2117849 | C | 4/1995 | |
| CA | 2 437 992 | | 11/1999 | |
| CN | 1160641 | | 10/1997 | |
| CN | 1057491 | C | 10/2000 | |
| CN | 1091690 | C | 10/2002 | |
| DE | 4216021 | A1 | 11/1993 | |
| DE | GEB. 91 16 990.9 | U1 | 1/1995 | |
| DE | 19625466 | C1 | 11/1997 | |
| DE | 29711115 | U | 12/1997 | |
| EP | 0 086 061 | | 8/1983 | |
| EP | 0 139 508 | A2 | 5/1985 | |
| EP | 0 412 459 | | 2/1991 | 347/19 |
| EP | 0 425 254 | A2 | 2/1991 | |
| EP | 0 440 110 | A1 | 8/1991 | |
| EP | 0 440 261 | | 8/1991 | |
| EP | 0 498 117 | | 8/1992 | |
| EP | 0529435 | A1 | 3/1993 | |
| EP | 0 551 752 | A2 | 7/1993 | |
| EP | 0 553 535 | A1 | 8/1993 | |
| EP | 0 564 069 | | 10/1993 | |
| EP | 0 571 093 | A2 | 11/1993 | |
| EP | 0 606 047 | A2 | 7/1994 | |
| EP | 0 639 462 | | 2/1995 | |
| EP | 0 645 243 | A2 | 3/1995 | |
| EP | 0 655 336 | A1 | 5/1995 | |
| EP | 0 657 292 | A1 | 6/1995 | |
| EP | 0 709 209 | A1 | 5/1996 | |
| EP | 0 709 211 | A1 | 5/1996 | |
| EP | 0 710 568 | | 5/1996 | |
| EP | 0 713 778 | | 5/1996 | |
| EP | 0 721 171 | A2 | 7/1996 | |
| EP | 0 778 145 | | 6/1997 | |
| EP | 0 778 148 | | 6/1997 | |
| EP | 0 789 322 | A2 | 8/1997 | |
| EP | 0 812 693 | | 12/1997 | |
| EP | 0 813 120 | A1 | 12/1997 | |
| EP | 0 821 445 | A1 | 1/1998 | |
| EP | 0 822 084 | A2 | 2/1998 | |
| EP | 0 832 747 | | 4/1998 | |
| EP | 0 839 660 | | 5/1998 | |
| EP | 0 854 043 | A2 | 7/1998 | |
| EP | 0 940 259 | A2 | 9/1999 | |
| EP | 0 940 260 | | 9/1999 | |
| EP | 0 960 736 | A1 | 12/1999 | |
| EP | 0 963 847 | | 12/1999 | |
| EP | 0 985 537 | | 3/2000 | |
| EP | 0 997 297 | | 5/2000 | |
| EP | 0 999 063 | A2 | 5/2000 | |
| EP | 1 004 449 | A2 | 5/2000 | |
| EP | 1 038 682 | A1 | 9/2000 | |
| EP | 1 080 917 | A1 | 3/2001 | |
| GB | 2 326 378 | | 12/1998 | |
| JP | 62-184856 | | 8/1987 | |
| JP | 2-99333 | | 4/1990 | |
| JP | 2-188246 | A | 7/1990 | |
| JP | 3-67657 | | 3/1991 | |
| JP | 3-227629 | A | 10/1991 | |
| JP | 3-227650 | A | 10/1991 | |
| JP | 4-133746 | A | 5/1992 | |
| JP | 4-247955 | | 9/1992 | |
| JP | 4-275156 | A | 9/1992 | |
| JP | 4-347655 | A | 12/1992 | |

| | | | | |
|---|---|---|---|---|
| JP | 5-84925 | A | 4/1993 | |
| JP | 5-114792 | | 5/1993 | |
| JP | 5-193127 | | 8/1993 | |
| JP | 5-229137 | | 9/1993 | |
| JP | 5-261935 | A | 10/1993 | |
| JP | 6-13100 | B2 | 2/1994 | |
| JP | 6-64187 | A | 3/1994 | |
| JP | 6-126981 | | 5/1994 | |
| JP | 6-155758 | | 6/1994 | |
| JP | 6-320750 | A | 11/1994 | |
| JP | 7-40532 | A | 2/1995 | |
| JP | 07-052377 | A | 2/1995 | |
| JP | 7-60953 | A | 3/1995 | |
| JP | 7-81077 | | 3/1995 | |
| JP | 7-232438 | | 9/1995 | |
| JP | 7-232439 | | 9/1995 | |
| JP | 7-246716 | A | 9/1995 | |
| JP | 7-266577 | A | 10/1995 | |
| JP | 7-314851 | A | 12/1995 | |
| JP | 8-39791 | A | 2/1996 | |
| JP | 8-39827 | A | 2/1996 | |
| JP | 8-102820 | A | 4/1996 | |
| JP | 8-132635 | | 5/1996 | |
| JP | 8-197748 | | 8/1996 | |
| JP | 2594912 | | 8/1996 | |
| JP | 2594912 | B2 | 12/1996 | |
| JP | 9-174876 | | 7/1997 | |
| JP | 9-174879 | | 7/1997 | |
| JP | 09-193410 | | 7/1997 | |
| JP | 9-286124 | A | 11/1997 | |
| JP | 10-24607 | A | 1/1998 | |
| JP | 10-034965 | | 2/1998 | |
| JP | 10-146680 | | 6/1998 | ..... 347/23 |
| JP | 10-151882 | | 6/1998 | ..... 347/23 |
| JP | 10-151883 | | 6/1998 | ..... 347/23 |
| JP | 10-309843 | A | 11/1998 | |
| JP | 2000-177145 | | 6/2000 | |
| WO | 90/00974 | | 2/1990 | |
| WO | 96/05061 | | 2/1996 | |
| WO | WO97/23352 | A1 | 7/1997 | |
| WO | 97/28001 | | 8/1997 | |
| WO | 98/04414 | | 2/1998 | |
| WO | 98/52762 | | 11/1998 | |
| WO | 98/55318 | | 12/1998 | |
| WO | 98/55322 | | 12/1998 | |
| WO | 98/55323 | | 12/1998 | |
| WO | 98/55324 | | 12/1998 | |
| WO | 98/55325 | | 12/1998 | |
| WO | 99/65695 | | 12/1999 | |
| WO | WO 00/21756 | A1 | 4/2000 | |
| WO | WO 00/26034 | A2 | 5/2000 | |
| WO | WO 00/47417 | A1 | 8/2000 | |
| WO | WO 01/54910 | A2 | 8/2001 | |
| WO | WO 02/11986 | A2 | 2/2002 | |

OTHER PUBLICATIONS

U.S. Appl. No. 09/318,269, filed May 1999, Naka.
U.S. Appl. No. 09/432,272, filed Nov. 1999, Saruta et al.
U.S. Appl. No. 09/449,646, filed Nov. 1999, Saruta et al.
U.S. Appl. No. 09/449,732, filed Nov. 1999, Saruta.
U.S. Appl. No. 09/449,737, filed Nov. 1999, Saruta.
U.S. Appl. No. 09/686,877, filed Oct. 2000, Shinada et al.
European Search Report Jan. 11, 2001.
European Search Report Jan. 15, 2001.
German Language document "Date Up", cover, p. 11, two unnumbered pages, plus complete English translation, (publication date unknown).
German Language document "Date Up 98/1", cover, pp. 2-5, 22 and one two unnumbered pages, plus complete English translation, (publication date unknown).
Communication of a Notice of Opposition, European Patent 0 997 297 (Feb. 24, 2004).
English Translation of portions of Notice of Opposition and Brief Communication in European Patent 0 997 2972 (Mar. 2, 2004).
Office Action from JP 2002-229479 (Sep. 29, 2003).
Search Report dated Oct. 19, 2004 in European Patent Appln. 03 024 553.4.
Search Report dated Oct. 6, 2004 in European Patent Appln. 04 004 435.6.
Decision of Grant, dated Feb. 26, 2001, in Russian Patent Appln. 2000103956.
Notice of Acceptance of Request for Invalidation in Chinese Pat. No. 00131800.4 (Jun. 1, 2005), and English translation.
Office Action in JP 11-125070 (date not ascertained).
Office Action from Japanese Appln. 11-125070 (w/ Engl. transln.).
Notice of Acceptance of Request for Invalidation for Chinese Appln. 00131800.4 (w/Engl. transln.) (Jun. 1, 2005).
Presentation "Large Format Printing With HP JetExpress Technology Hewlett-Packard, 1999", Dr. Ross R. Allen (marked "Anlage [Exhibit] L7") (pp. 1-25) and cleaner copy of same (pp. 1-27).
"Druckspiegel" (Feb. 1999) (cover, pp. 3-4, 14, 58) (marked "Anlage [Exhibit] L8").
"HP DesignJet Gro β formatdruker Für CAD/GIS-Anwendungen" (2 pgs) (date not legible) (marked "Anlage [Exhibit] L8a").
"Large Output", No. 5 (2 pgs) (1999) (marked "Anlage [Exhibit] L8b").
Presentation "Inkjet in the Office or Home—No Marked Differences or Different Materials", Rob Beeson, Hewlett Packard Company (Mar. 25, 1999, Hamburg, Germany) (marked "Anlage [Exhibit] D13").
Notice of Acceptance of Request for Invalidation in Chinese Patent 00131800.4 (Nov. 20, 2005), with English Translation.
Notice of Acceptance of Request for Invalidation in Chinese Patent 00131800.4 (Jan. 18, 2006), with English Translation.
Notice of Acceptance of Request for Invalidation in Chinese Patents No. 00131800.4 (Apr. 24, 2006), with English Translation.
Notice of Investigation of the U.S. International Trade Commission in the Matter of Certain Ink Cartridges and Components Thereof, Inv. No. 337-TA-565 ( MAr. 17, 2006) (unsigned).
Office Action from U.S. Appl. No. 11/253,903 (May 27, 2006).
Office Action from U.S. Appl. No. 10/269,257 ( Apr. 27, 2006).
Respondent Ninestar Technology Co. Ltd.'s (Zhuhai) Third Supplemental Responses to Complainant's First and Second Sets of Interrogatories (Nos. 16-19 . . . and 146) (including Exhibits A-C), U.S. ITC Investigation No. 337-TA-565 (Aug. 18, 2006).
Respondent Ninestar Technology Co. Ltd.'s Third Supplemental Responses to Complainant's First and Second Set of Interrogatories (Nos. 21-24 . . . 138-145), U.S. ITC Investigation No. 337-TA-565 (Aug. 18, 2006).
Respondent Town Sky Inc.'s Third Supplemental Responses to Complainant's First and Second Set of Interrogatories (Nos. 21-24 . . . 138-145), U.S. ITC Investigation No. 337-TA-565 (Aug. 18, 2006).
Respondent Dataproducts USA LLC's Second Supplemental Objections and Responses to Complainant's First Set of Interrogatories, U.S. ITC Investigation No. 337-TA-565 (Aug. 16, 2006).
Respondent Dataproducts USA LLC's Second Supplemental Objections and Responses to Complainant's Second Set of Interrogatories, U.S. ITC Investigation No. 337-TA-565 (Aug. 16, 2006).
Artech's Preliminary Proposed Claim Constructions, ITC Inv. No. 337-TA-565 (3 pgs.).
Artech's Preliminary Non-Infringement Claim Charts, ITC Inv. No. 337-TA-565 (18 Pgs.).
Artech's Preliminary Invalidity Claim Charts, ITC Inv. No. 337-TA-565 (20 pgs.).

* cited by examiner (a)

(b)

(a)

(b)

(a)

(b)

(a)

(b)

(a)

(b)

(a)

(b)

(a)

(b)

(c)

(a)

(b)

(a)

(b)

(a)

(b)

INK-JET PRINTING APPARATUS AND INK CARTRIDGE THEREFOR

CROSS-REFERENCE TO RELATED APPLICATIONS

This application is a division of U.S. patent application Ser. No. 09/484,458, filed on Jan. 18, 2000 now U.S. Pat. No. 6,502,917, which is a continuation-in-part of PCT Application No. PCT/JP99/02579, filed May 18, 1999, which claims benefit of priority based on Japanese Patent Application Nos. 10-151883, filed May 18, 1998, 10-151882, filed May 18, 1998, 10-180519, filed Jun. 26, 1998, 10-266109, filed Sep. 21, 1998, 10-301782, filed Oct. 23, 1998, and 11-78843, filed Mar. 24, 1999.

BACKGROUND OF THE INVENTION

1. Field of the Invention

The present invention relates to a printing apparatus to which ink is supplied from a replaceable ink cartridge for printing on a recording medium, ejecting an ink droplet from nozzle apertures and an ink cartridge suitable for the above printing apparatus.

2. Conventional Art

An ink-jet printing apparatus is known in which there is provided with a print head for supplying a driving signal to a piezoelectric vibrator or heating means to print data, pressurizing ink by energy generated by the piezoelectric vibrator or the heating means and thereby ejecting ink droplets from nozzle apertures and an ink cartridge housing ink for supplying ink to the above print head.

As the print quality depends upon the resolution of the print head and greatly depends upon the viscosity of ink, the degree of bleeding on a recording medium or the like, the characteristics of ink are improved to enhance the print quality. Even if the same ink is used, a driving method of a print head suitable for the characteristics of ink is improved to enhance the print quality. Further, a maintenance condition such as the cycle of no-medium-ejection or forced ejection in a capping state is improved to prevent the nozzle apertures from clogging.

As described above, the print quality of a printing apparatus can be enhanced when the ink characteristics and the driving method for a print head work together, not only by the ink characteristics. Although a result by such technical development can be applied to a newly manufactured ink-jet printing apparatus, the application to a printing apparatus already shipped from a manufacturer would be practically impossible when taking into consideration the cost, labor and others. This is because that the printing apparatus has to be carried to the manufacturer and storing means in which control data is recorded must be exchanged.

To cope with such a problem, as disclosed in Japanese Patent Publication No. 2594912 for example, there has been proposed a printing apparatus in which semiconductor storage means and an electrode connecting to the storage means are arranged on an ink cartridge, a group of electrodes is also arranged on the body of the printing apparatus, data stored in the semiconductor storage means is read, and recording operation is controlled in accordance with the data.

However, there is a problem that contact with the semiconductor storage means is failed because of rough operation for attaching or detaching an ink cartridge by a user or play between a carriage and an ink cartridge, the reading of data is disabled because of electrification or the application of a signal at unsuitable timing and, in the worst case, data is lost and recording operation is disabled.

The present invention is made in view of such a problem and an object of which is to provide an ink-jet printing apparatus wherein data stored in semiconductor storage means can be prevented from being lost independent of unsuitable operation for attaching or detaching an ink cartridge.

Another object of the present invention is to provide an ink cartridge suitable for the above printing apparatus.

THE BEST MODE FOR EMBODYING THE PRESENT INVENTION

Figure 1:
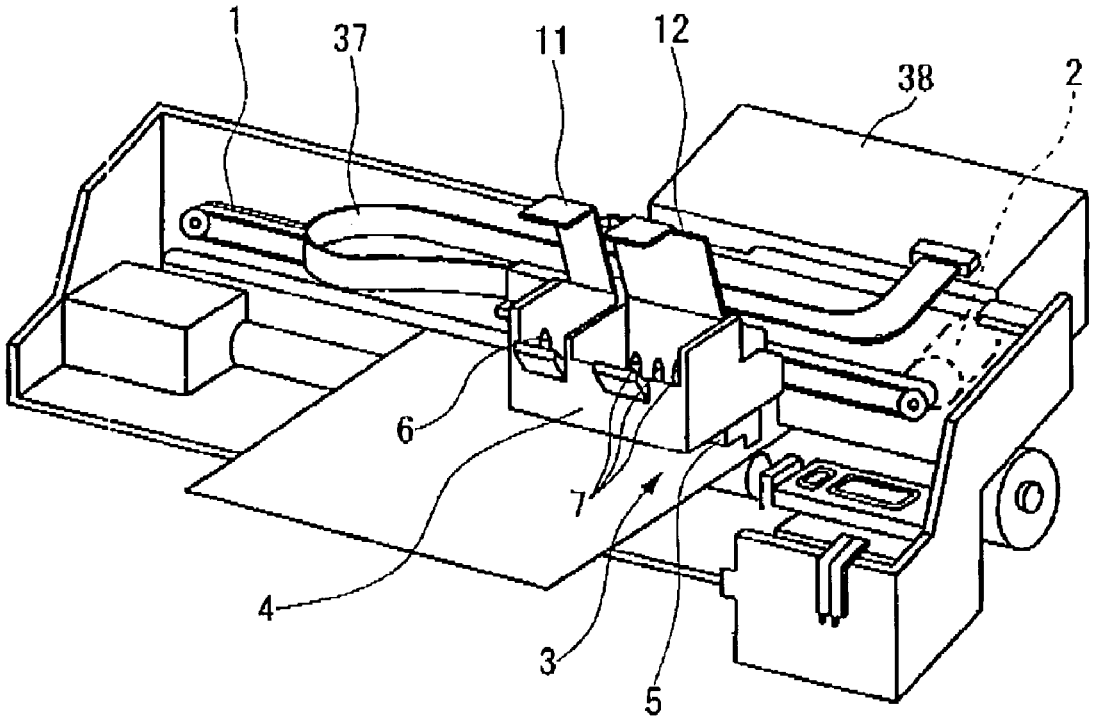
FIG. 1 shows an embodiment of a printing apparatus according to the present invention mainly in relation to its recording mechanism.

FIG. 1 shows one embodiment of an ink-jet printing apparatus according to the present invention with respect to a printing mechanism. A holder 4 for installing a black ink cartridge 40 housing black ink described later and a color ink cartridge 50 housing color ink is disposed on an upper surface of a carriage 3 connecting to a driving motor 2 via a timing belt 1. A print head 5 to which ink is supplied from each ink cartridge is provided on the lower surface of the carriage 3.

Figure 2:
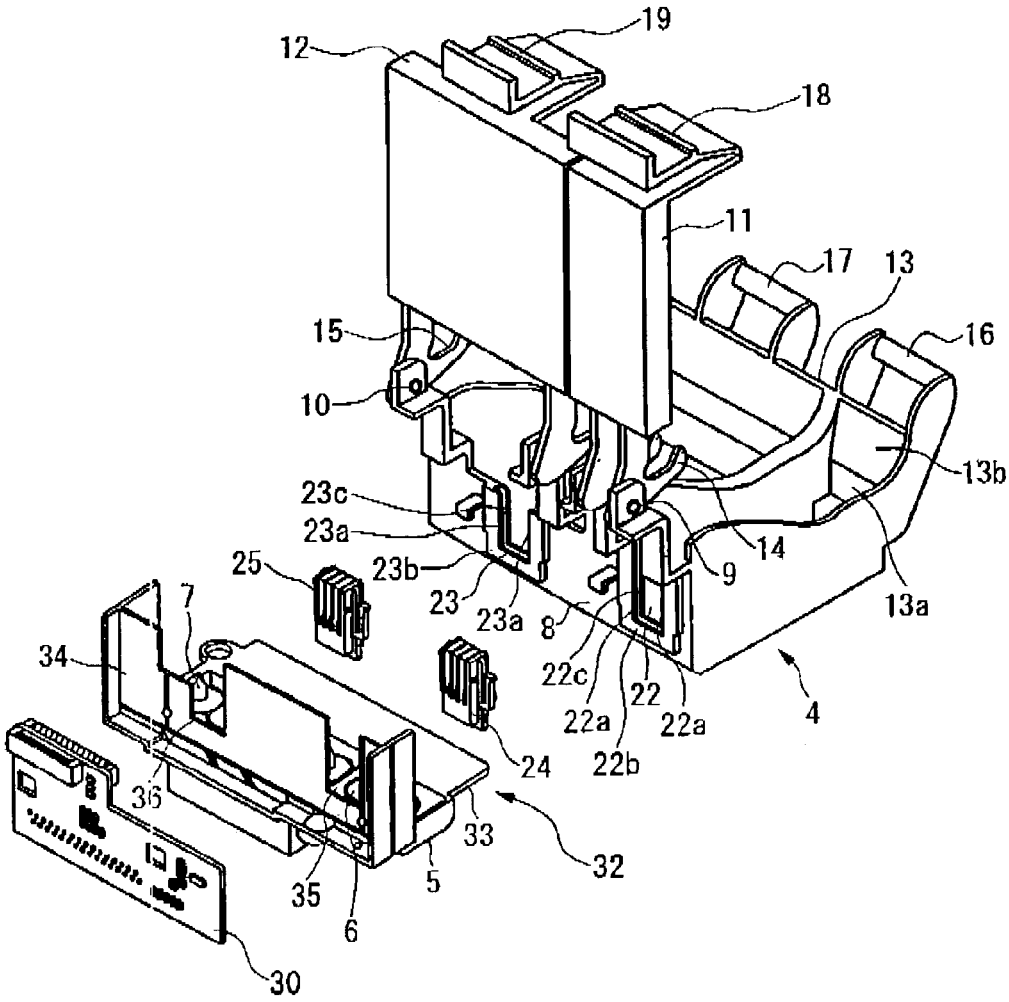
FIG. 2 is an assembly perspective drawing showing an embodiment of a carriage in the above printing apparatus.
Figure 3:
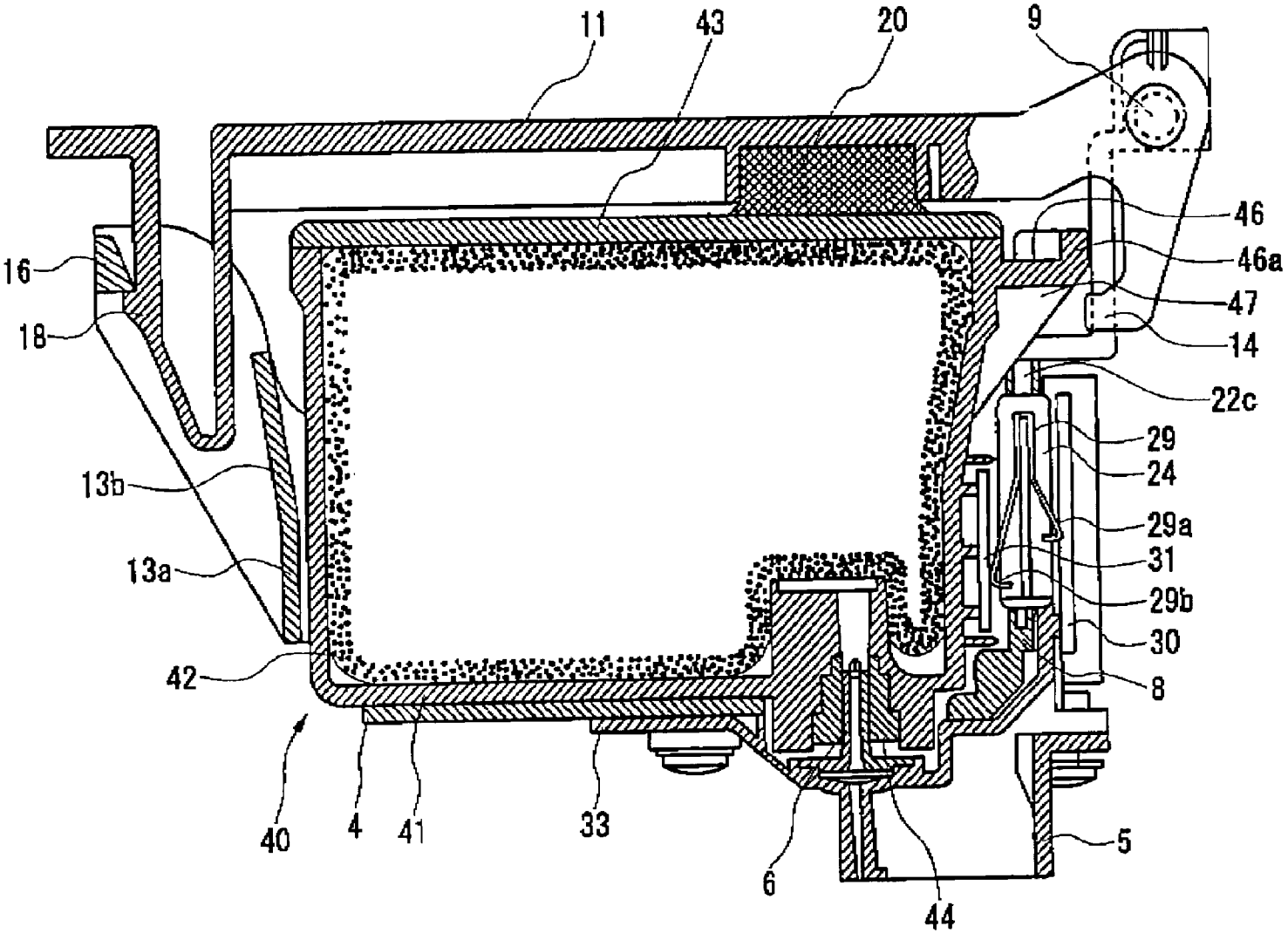
FIG. 3 shows an embodiment of the carriage in the above printing apparatus in a state in which an ink cartridge is installed.

FIG. 2 shows an embodiment of the carriage in a state in which the carriage is disassembled into a holder part and a head part and FIG. 3 is a sectional structural view sectioned at an ink supply port 44 of the black ink cartridge 40.

Ink supply needles 6 and 7 communicating with the print head 5 are vertically penetrated in the bottom of the carriage 3 so that they are located on the back side of the device, that is, on the side of the timing belt 1. Levers 11 and 12 are respectively mounted at the upper end of a vertical wall 8 opposite to each vicinity of the ink supply needles 6 and 7 out of the vertical wall forming the holder 4 so that the levers are respectively rotatable along shafts 9 and 10. A wall 13 located on the side of each free end of the levers 11 and 12 is composed of a vertical part 13*a* near the bottom and a sloped part 13*b* sloped outward in its upper area.

The levers 11 and 12 respectively extend from the vicinity of the shafts 9 and 10 so that projections 14 and 15 respectively fitted to overhangs 46 and 56 described later at the upper end of the ink cartridges 40 and 50 are approximately perpendicular to each body of the respective levers 11 and 12, and hook portions 18 and 19 elastically fitted to hooks 16 and 17 formed in the sloped part 13*b* of the holder 4 are respectively formed.

Figure 4:
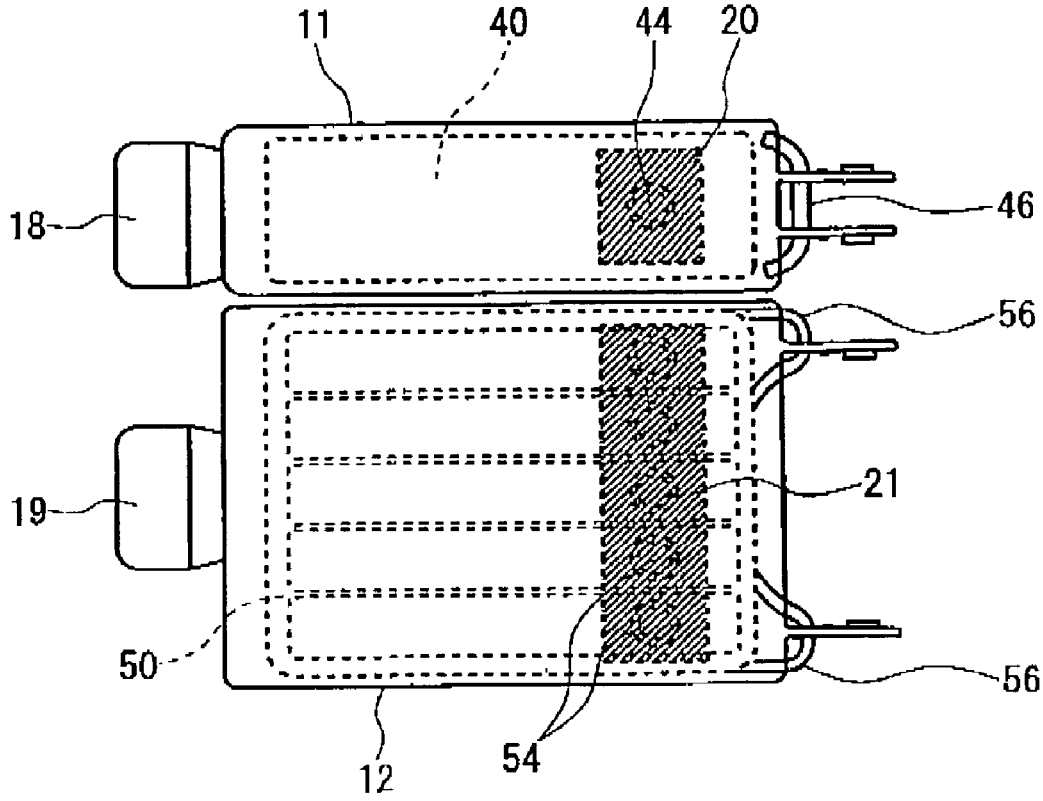
FIG. 4 is a top view showing an embodiment of the carriage in the above printing apparatus in a state in which an ink cartridge is installed, and FIGS. 5(*a*) and 5(*b*) show an embodiment of a contact mechanism of the above carriage.

Elastic members 20 and 21 for elastically pressing at least the area opposite to the ink supply port 44 or 54 of each ink cartridge 40 or 50, as shown in FIG. 4, when the ink cartridge 40 is set in a normal position are provided to the back of each lever 11 or 12, that is, the face opposite to a cover 43 of the ink cartridge 40.

For these elastic members 20 and 21, material having the coefficient of friction of 0.5 or more for the respective covers 43 and 53 of the ink cartridges 40 and 50, for example, rubber the hardness of which is 10° to 70°, foamed material and a felt member and, further, gelled material are employed.

Windows 22 and 23 each upper part of which is open are respectively formed on the vertical wall 8 located near the ink supply needle. Further, continuous grooves 22*c* and 23*c* are respectively formed on vertical walls 22*a* and 23*a* and at the bottoms 22*b* and 23*b* to respectively form each window, and contact mechanisms 24 and 25 are respectively inserted into these grooves 22*c* and 23*c* and fixed therein.

Figure 5:
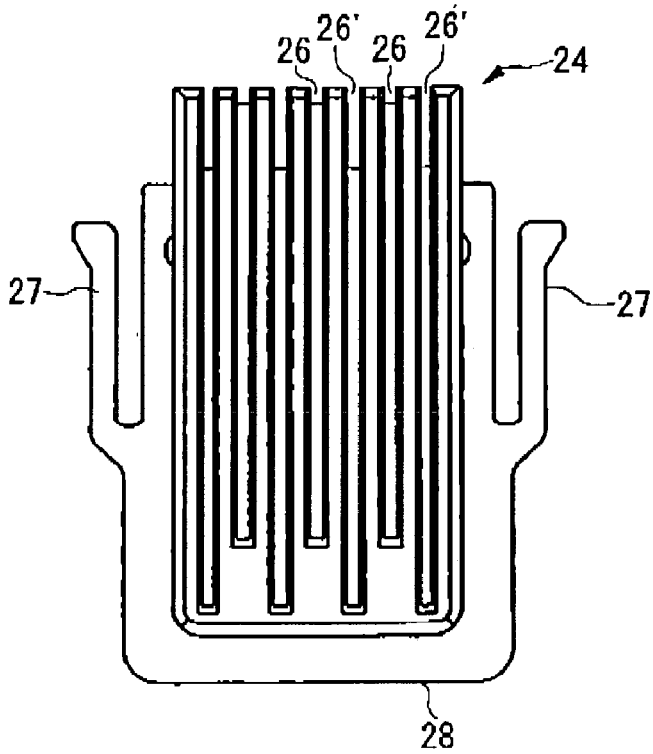
Figure 5:
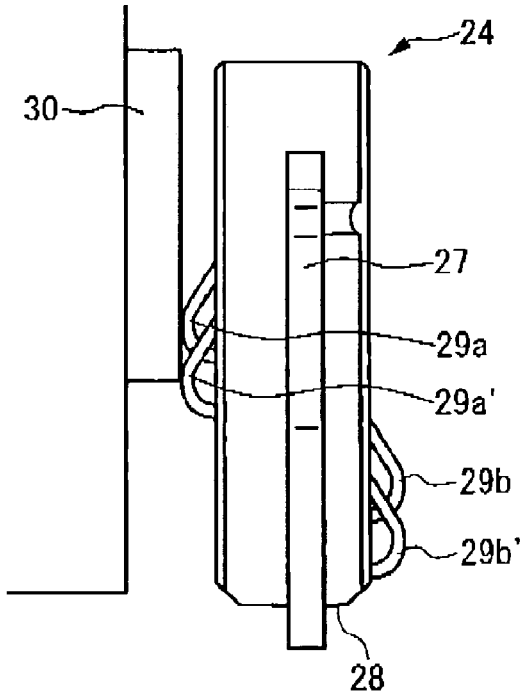

As the contact mechanisms 24 and 25 are composed so that they have approximately the same structure, one contact mechanism 24 will be described below. As shown in FIGS. 5(*a*) and 5(*b*), two types of slits 26 and 26' different in depth are formed approximately at fixed pitch, the contact forming members 29 and 29' provided with conductivity and elasticity are fitted into each slit 26 or 26' of the body 28 provided with an elastically transformable pawl 27 on both sides. These contact forming members 29 and 29' are respectively located unevenly and fixed so that they are exposed on the superficial and rear sides of the body 28.

Areas 29*a* and 29'*a* exposed from each one face of the contact forming members 29 and 29' respectively elastically come in contact with the contact of a circuit board 30 by composing the contact mechanisms 24 and 25 as described above and fitting the circuit board 30 in front of a vertical wall 34 of a base 32, areas 29*b* and 29'*b* exposed from the other face respectively elastically come in contact with the contact of a circuit board 31 described later of the ink cartridges 40 and 50, and conduction is acquired.

In the meantime, the print head 5 is fixed to the bottom of the holder 4 via a horizontal part 33 of the base 32 composed together with the ink supply needles 6 and 7 so that the base is approximately L-type. Windows 35 and 36 are respectively formed in areas opposite to the contact mechanism 24 and 25 on the vertical wall 34 of the base 32 and the above circuit board 30 is held on its front side.

The circuit board 30 is connected to control means 38 via a flexible cable 37 shown in FIG. 1, supplies a driving signal for instructing the print head 5 to jet an ink droplet and comes in contact with the circuit board 31 of the ink cartridges 40 and 50 respectively via the contact mechanisms 24 and 25.

Figure 6:
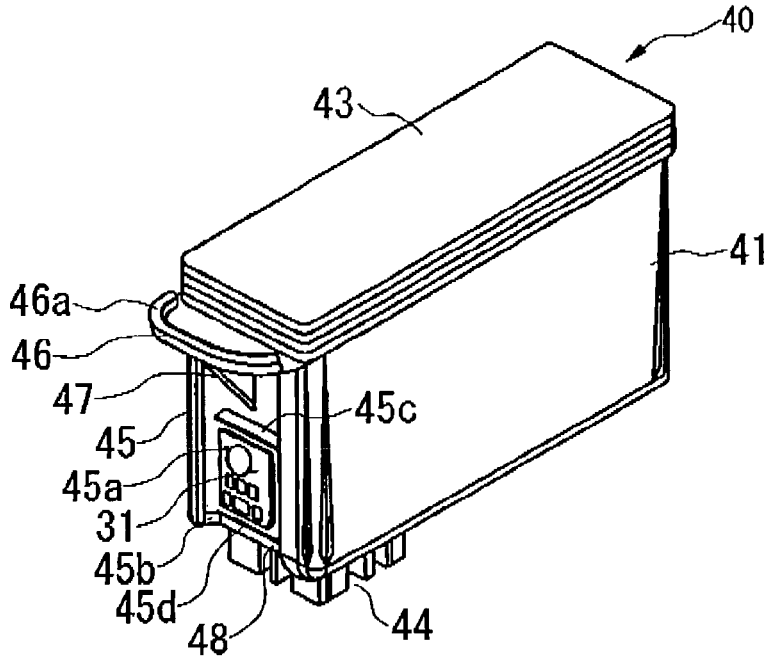
FIGS. 6(*a*) and 6(*b*) show an embodiment of an ink cartridge suitable for the above printing apparatus, FIGS. 7(*a*) to 7(*c*) show an embodiment of a circuit board mounted on the ink cartridge in relation to its superficial and rear structure and the size of an electrode and FIGS. 7(*d*) and 7(*e*) show a state of contact with a contact.
Figure 6:
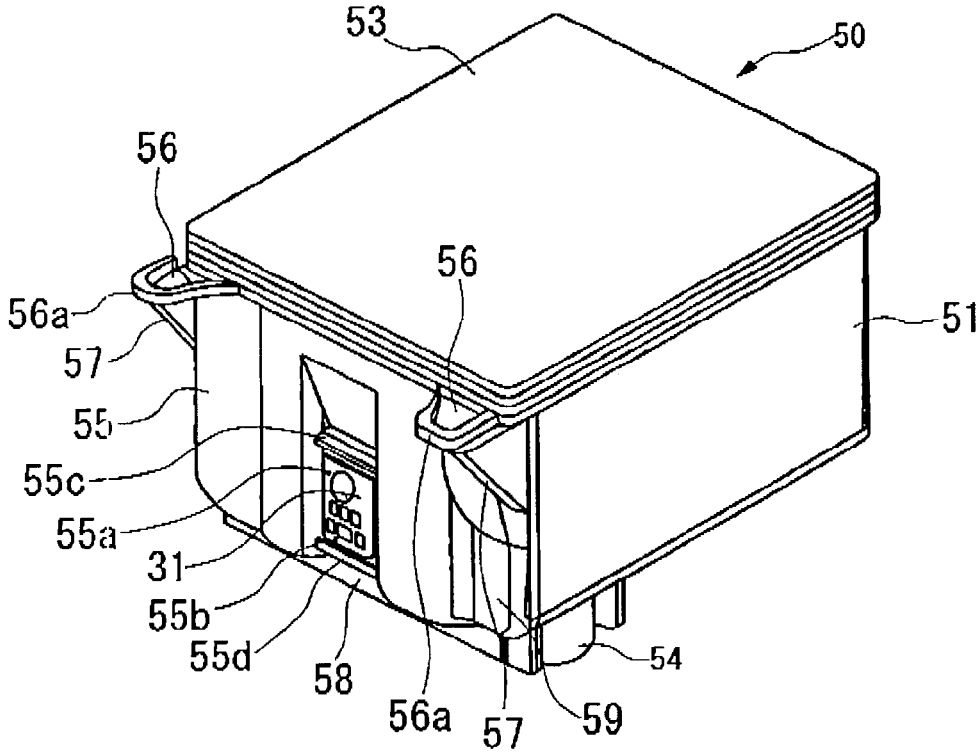

FIGS. 6(*a*) and 6(*b*) show an embodiment of the black ink cartridge 40 and the color ink cartridge 50, a porous member 42 impregnated with ink is respectively housed in containers 41 and 51 formed so that they are substantially rectangular parallelopiped and the respective upper faces are respectively sealed by the covers 43 and 53.

The ink supply ports 44 and 54 are respectively formed in positions opposite to the ink supply needles 6 and 7 when the ink cartridges are respectively installed in the holder 4 at the bottom of the respective containers 41 and 51, and overhang portions 46, 56 and 56 for fitting in the respective projections 14 and 15 of the levers 11 and 12 are integrated with the respective upper ends of the vertical walls 45 and 55 on the side of the ink supply ports. As shown in FIGS. 6(*a*) and 6(*b*), the overhang portions 46, 56 protrude from the housing of the ink cartridges 40, 50, respectively, in a direction perpendicular to a plane of the circuit board 31. The overhang portion 46 of the black ink cartridge 40 is continuously formed from one end to the other end, the overhang portion 56 of the color ink cartridge 50 are individually formed so that they are located on both sides and, further, triangular ribs 47 and 57 are respectively formed between each lower surface and the wall 45 or 55. A reference number 59 denotes a concave portion for preventing wrong insertion.

Concave portions 48 and 58 are respectively formed on the vertical walls 45 and 55 on the side of the ink supply ports so that the concave portions are respectively located in the center of the width of the ink cartridges 40 and 50 and the circuit boards 31 are respectively installed in the above concave portions.

As best shown in FIGS. 6(*a*) and 6(*b*), the circuit boards 31 is attached on a side wall having the shorter width than the other side wall of the ink cartridges 40 and 50 and located on a central line of the ink supply ports 44 and 54, respectively. The circuit board 31 is disposed substantially in parallel with the side wall. In addition, as shown in FIG. 6(*b*), the ink cartridge 50 is provided with a plurality of ink chambers for different ink, and the circuit board 31 is disposed substantially at a center of the total width of the plurality of the ink chambers. Because the circuit boards 31 are located as described above, the accurate positional relationship of the circuit boards 31 with the contact member of the printing apparatus can be assured when the ink cartridges 40 and 50 are mounted on the printing apparatus.

Further, it is preferable that the height or depth of the concave portions in which the circuit boards 31 are to be installed is higher than that of the circuit board 31. Alternately, a plane of the circuit boards 31 is aligned with a surface of the side wall of the ink cartridge 40, 50 on which the circuit boards 31 are disposed. Because of these arrangement, the circuit boards 31 can be prevented from being touched by a user's finger when the ink cartridge is mounted on the printing apparatus.

Figure 7:
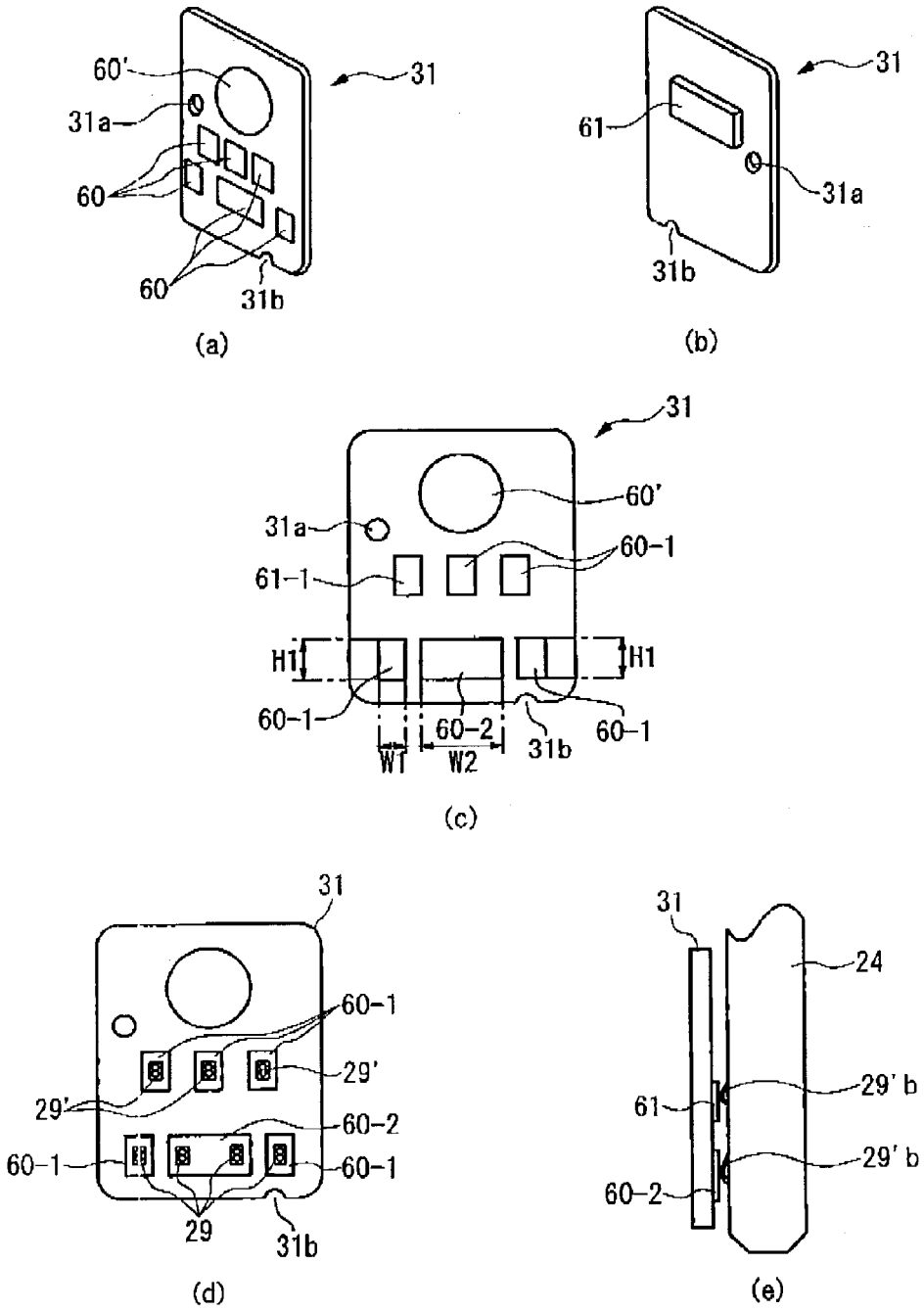

Contacts 60 in plural rows in a direction in which the cartridge is inserted, in two rows in this embodiment, are formed in a position respectively opposite to the contact forming members 29 and 29' of the above contact mechanism 24 on the side of the surface when the circuit board is attached to the ink cartridge of the circuit board 31 as shown in FIG. 7(*a*). A semiconductor storage means 61 may be mounted at the rear surface of the circuit board 31 so that the semiconductor storage means is connected to these contacts 60 and, if necessary, is molded by ink-resistant material and is kept unexposed. The semiconductor storage means 61 may store data of the quantity of ink housed in the ink cartridge 40 or 50 to which the semiconductor storage means is provided, the manufacturing date of the ink, its trademark and the like. If required, the semiconductor storage means 61 stores data such as a maintenance status transmitted from the body of the printing apparatus. A reference number 60' denotes an electrode used for a check during its manufacturing process. The electrode 60' is grounded when used.

As shown in FIG. 7, the electrodes 60 are distanced from an edge of the circuit board 31 or from a position of the circuit board where a contact member of the printing apparatus first comes into abutment when the ink cartridge is mounted on the printing apparatus. Such arrangement is advantageous in that the electrodes 60 on the circuit board 31 can be protected from a damage which might be given to the electrodes 60 when the circuit board 31 comes into abutment with the contact member of the printing apparatus. Further, since the electrodes 60 are distanced from the edge of the circuit board 31, it is easy to control the position of the circuit board 31 with respect to the contact member of the printing apparatus.

Figure 11:
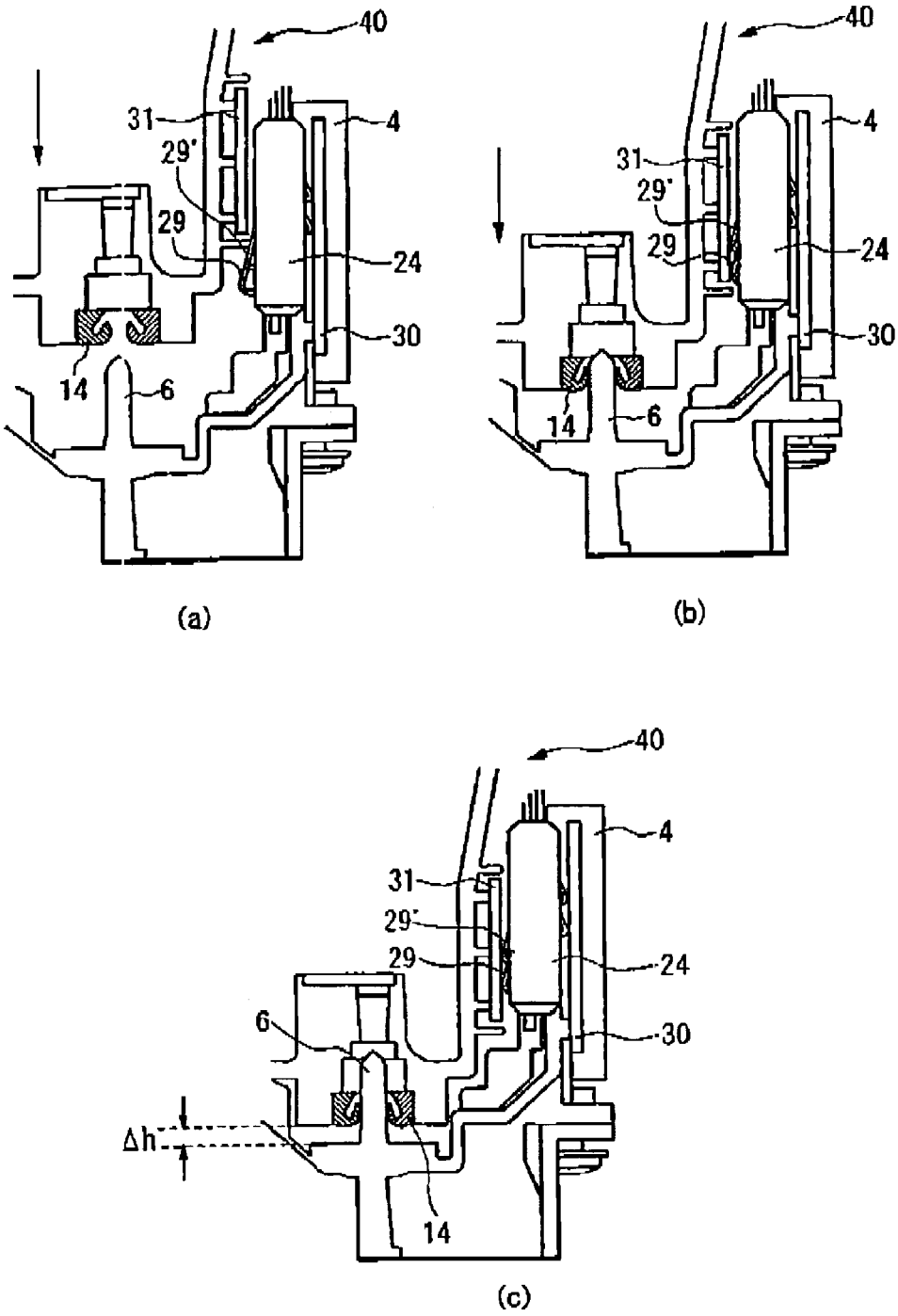

Out of electrodes 60 formed on the circuit board 31, for a small electrode 60-1 shown in FIG. 7(*c*), the height H1 may be 1.8 mm and the width W1 1 mm, for a large electrode 60-2, the height H2 may be 1.8 mm and the width W2 is 3 mm. Particularly, contact with the contact forming members 29 can be secured by forming the small electrode 60-1 in a rectangle in which the length in the inserted direction of the ink cartridge 40 or 50 is longer than that in the other direction, minimizing the width W1 of the electrode even if there is a lift Δh between the ink cartridge 40 or 50 and the holder 4 as shown in FIG. 11(*c*).

On the circuit board 31 on which the semiconductor storage means 61 is mounted as described above, at least one through hole 31*a* and a concave portion 31*b* are formed, and projections 45*a*, 45*b*, 55*a* and 55*b* for positioning together with the through hole 31*a* and the concave portion 31*b* and overhangs 45*c*, 45*d*, 55*c* and 55*d* which are elastically in contact with the side of the circuit board 31 such as a rib and a pawl are respectively formed near the ink supply ports 44 and 45 in a direction in which the cartridge is inserted in the vertical direction of the circuit board 31 on the vertical walls 45 and 55 which are respectively the mounting faces of the ink cartridges 40 and 50. In another arrangement, if desired, the circuit board 31 may be provided with at least one projection which engages with a concave portion or through-hole for positioning the circuit board 31 with respect to the ink cartridge.

Hereby, the circuit board can be readily installed, respectively fitting to the ribs 45*c*, 45*d*, 55*c* and 55*d* by pressing the semiconductor storage means 61 on the respective walls 45 and 55 of the cartridges 40 and 50, regulating the position of the semiconductor storage means according to the projection. Hereby, the cartridge is not required to be thickened uselessly for forming a hole for a screw, filling ink of sufficient quantity is enabled, not screwing fastening in which work is relatively troublesome but not riveting in which work is easy can be applied and a manufacturing process can be simplified. The height of the ribs 45*c*, 45*d*, 55*c* and 55*d* may preferably be higher than a plane of the circuit board 31 when the circuit board is disposed on the ink cartridge, so that the circuit board 31 my be prevented from touching user's finger when he or she mounts the ink cartridge on the printing apparatus.

Figure 8:
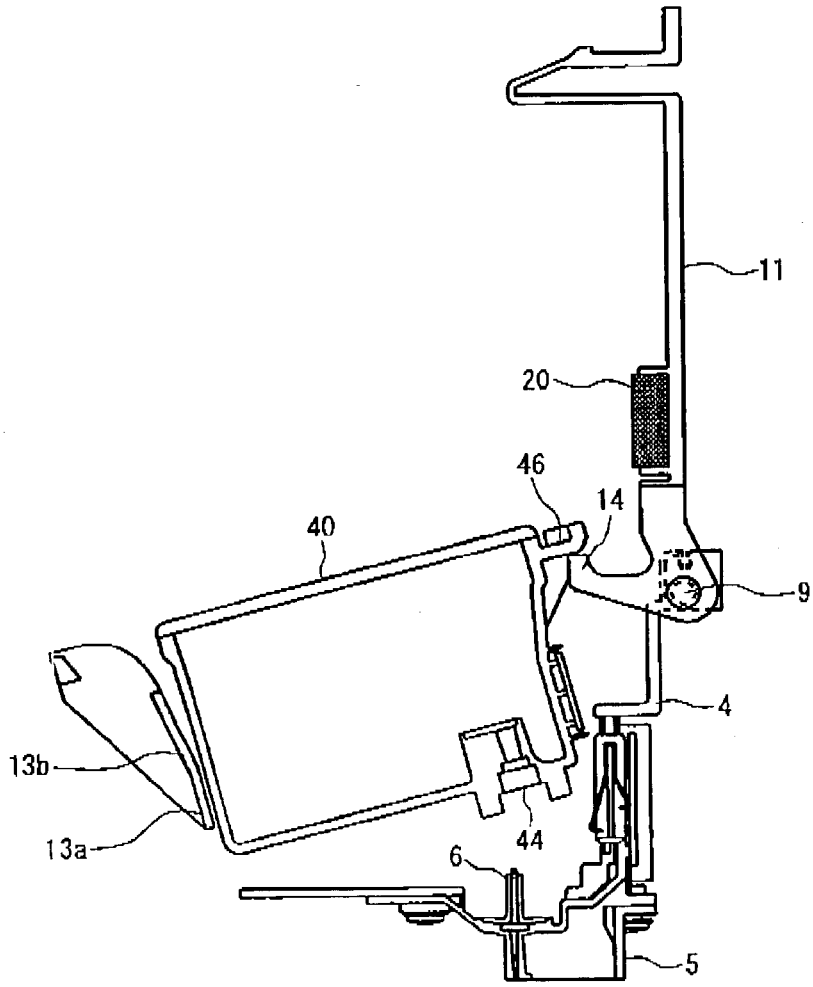
FIGS. 8 and 9 show a process in which the above ink cartridge is installed.

In this embodiment, when the cartridge 40 is installed with the lever 11 lifted up to an approximately vertical position, the overhang 46 formed on the side of the ink supply port is caught by the projection 14 of the lever 11, the side of the other end is supported by the sloped part 13*b* of the holder 4 and held in a state in which the side of the ink supply port is lifted as shown in FIG. 8. In the above installation, if the ink cartridge 40 comes in abutment against the body of the printing apparatus, the circuit board 31 is protected by the overhang portion 46 in the upper part, as the circuit board 31 is also housed in the concave portion 48, no shock directly operates on the circuit board 31 and damage is prevented.

Figure 9:
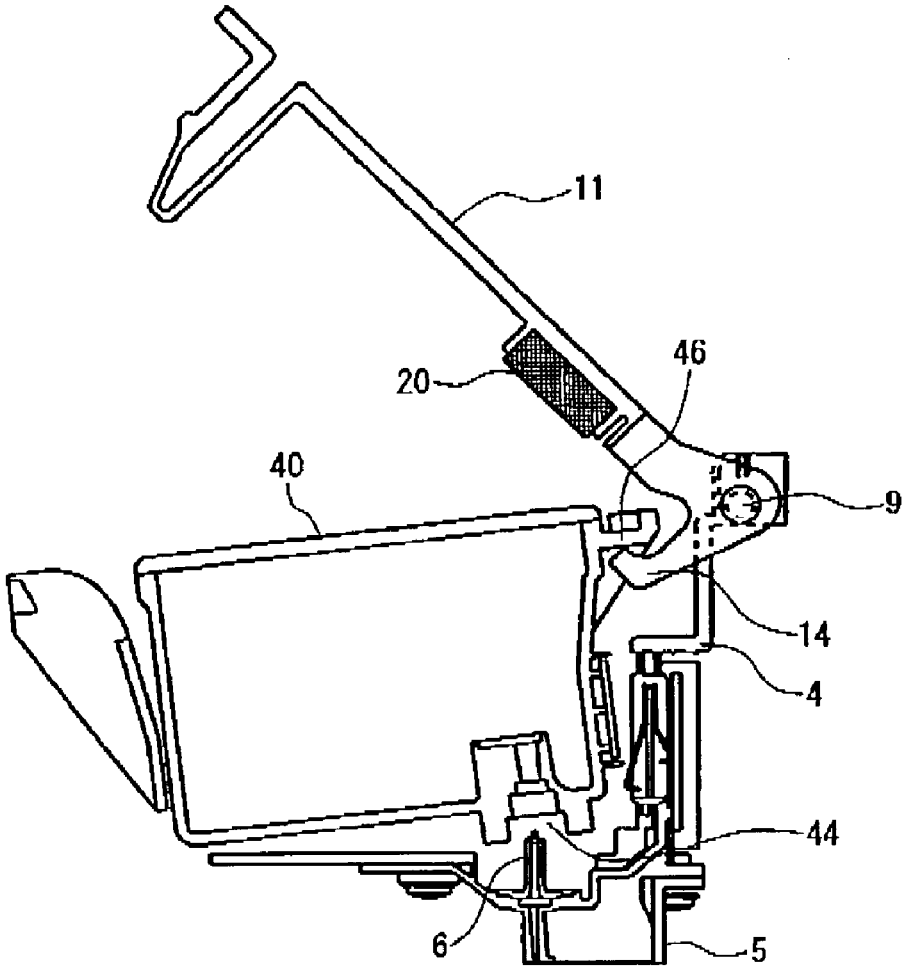

When the lever 11 is closed in this state, the projection 14 is turned downward, the ink cartridge 40 is lowered, approximately keeping the posture when it is installed and the ink supply port 44 comes in contact with the tip end of the ink supply needle 6 as shown in FIG. 9. As shown in FIG. 9, the circuit board 31 is located at an opposite position of a fulcrum of the ink cartridge 40 when it is mounted on or removed from the holder of the printing apparatus. Further, as best shown in FIGS. 6, 8 and 9, the circuit board 31, the ink supply port 44, 54 and the overhang members 46, 56 are located at the same side of the ink cartridges 41, 51, respectively. Owing to such structure, the positioning of the circuit board 31 with respect to the contact member of the printing apparatus is not largely affected by the quantity a of a turn when the ink cartridge 40 is mounted on the holder of the printing apparatus.

As a part over the ink supply port 44 of the cartridge 40 is pressed by the elastic member 20 when the lever 11 is further turned in this state, the ink supply port 44 is pressed on the ink supply needle 6 by pressure amplified based upon the ratio of the length of the lever 11 and distance between the shaft 9 and the elastic member 20. When the lever 11 is pressed to the end, it is fixed by the hook 16 with the lever 11 always elastically pressing the cover 43 of the ink cartridge 40 on the side of the ink supply needle via the elastic member 20 as shown in FIG. 3.

Hereby, the ink cartridge 40 is elastically pressed under fixed pressure with the ink supply port 44 fitted to the ink supply needle 6 and a state in which the ink supply port 44 is fitted to the ink supply needle 6, holding them airtight is maintained independent of vibration in printing, shock and vibration due to the movement of a printing apparatus and others.

As the circuit board 31 is located in the center in the width of the cartridge 40 on the vertical wall 45 in the vicinity of the ink supply port, the vertical wall 45 on which the circuit board 31 is fixed is moved possibly in parallel with a locus on which the ink supply port 44 is regulated by the ink supply needle 6.

Figure 10:
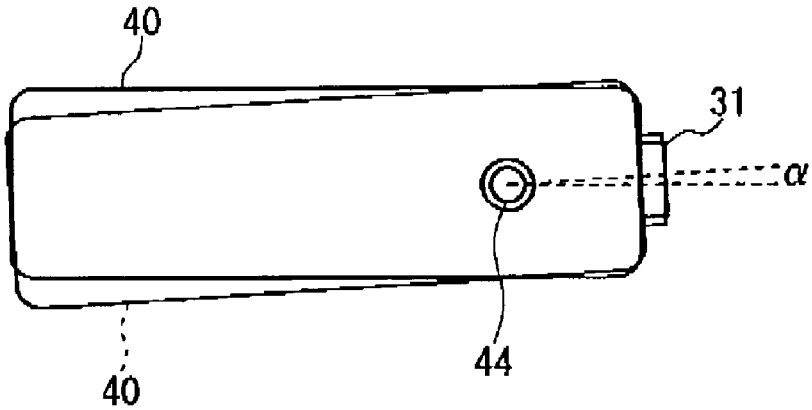
FIG. 10 shows the quantity of the movement of mainly an ink supply port where an ink supply needle is inserted of the ink cartridge, and FIGS. 11(*a*) to 11(*c*) show a process of contact between the circuit board of the ink cartridge and a contact of a holder.

In the meantime, as the circuit board 31 is located in the vicinity of the ink supply needle 6 even if the cartridge 40 rattles when it is installed and a turn is caused with the ink supply needle 6 in the center, the quantity a of a turn is extremely small as shown in FIG. 10.

For the arrangement set forth above, the circuit board 31 is moved according to a preset path as shown in FIGS. 11(*a*) to 11(*c*), comes in contact with the contacts 29 and 29' of the contact mechanism 24 in defined order and in order grouped vertically, prevents data from being lost in the semiconductor storage means 61 due to the application of signals in unprepared order, the contact forming members 29 and 29' elastically come in contact with the contact 60 of the circuit board 31 in a state in which the ink cartridge 40 is securely installed, and the reading of data stored in the semiconductor storage means 61 and the writing of data on the side of the printing apparatus are enabled.

When the installation of the ink cartridge 40 or 50 is finished, the contact forming member 29*a* of the contact mechanism 24 comes in contact with the electrodes in the upper row out of the electrodes shown in FIGS. 7(*d*) and 7(*e*) and the contact forming member 29'*a* comes in contact with the electrodes in the lower row. Two contact forming members 29 are in contact with the electrode 60-2 arranged in the center in the lower row. The two contact forming members 29 touched to the electrodes 60-2 are grounded and it can be judged by detecting conduction between these on the side of the printing apparatus whether the ink cartridge 40 or 50 is installed or not. Further, as the width W2 of the electrode 60-2 is larger than that of the other electrode 60-1 and the electrode 60-2 is located on the central line of the ink supply port, the electrode 60-2 securely comes in contact with the contact forming member 29'. As the electrodes 60-1 and 60-2 are exposed and a user can check them easily in case the failure of contact is verified, the electrodes are simply wiped by cloth and others and conduction can be recovered. As shown in FIG. 7, the electrode 60-2 is disposed on the same side of the circuit board 31 as the other electrodes 60-1, 61-1 are formed.

When fitting to the hook 16 is released and the lever 11 is turned upward in case ink in the ink cartridge 40 is consumed, the projection 14 of the lever 11 is fitted to the lower part of the overhang portion 46 of the ink cartridge in the process as shown in FIG. 9. When the lever 11 is further turned in this state, the ink cartridge 40 is lifted by the lever 11 and fitting to the ink supply needle 6 is released. As the upper half of the ink cartridge 40 is exposed from the holder with the overhang 46 on the side of the ink supply port supported by the projection 14 of the lever 11 as shown in FIG. 8 when the turn of the lever 11 up to an approximately vertical position is finished, the ink cartridge can be easily extracted.

Figure 12:
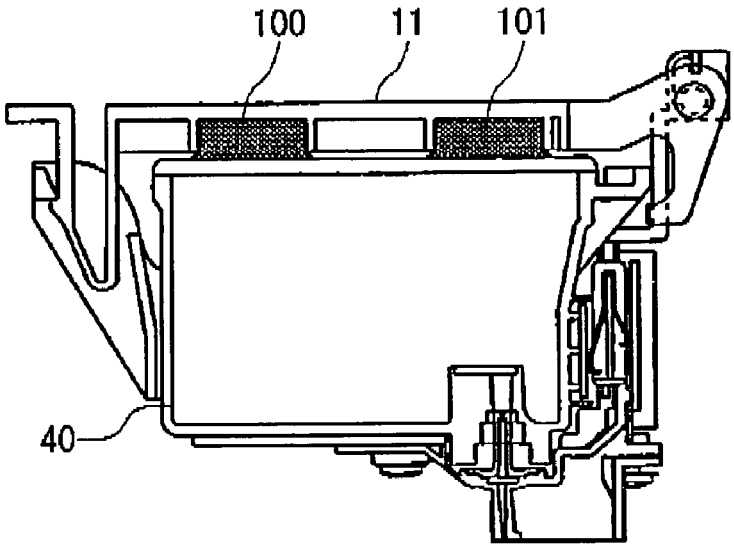
FIGS. 12(*a*), 12(*b*) to FIGS. 14(*a*) and 14(*b*) are respectively sectional views and top views showing another embodiment of the present invention in a state in which the ink cartridge is installed.
Figure 12:
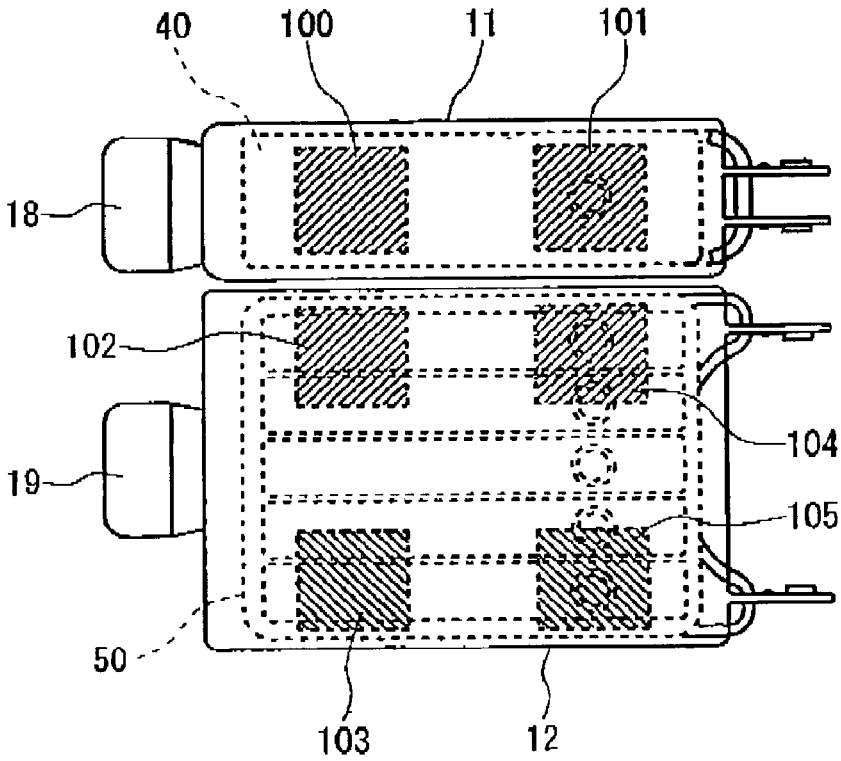

In the above embodiment, only the side of the ink supply port is pressed, however, it is more effective that elastic members 100,101 are provided in two locations in the longitudinal direction of the lever 11 as shown in FIGS. 12(*a*) and 12(*b*) and in the case of the wider cartridge 50 for color ink, elastic members 102 to 105 are provided in four locations, dispersing the elastic members in the direction of the width of the lever 12.

Figure 13:
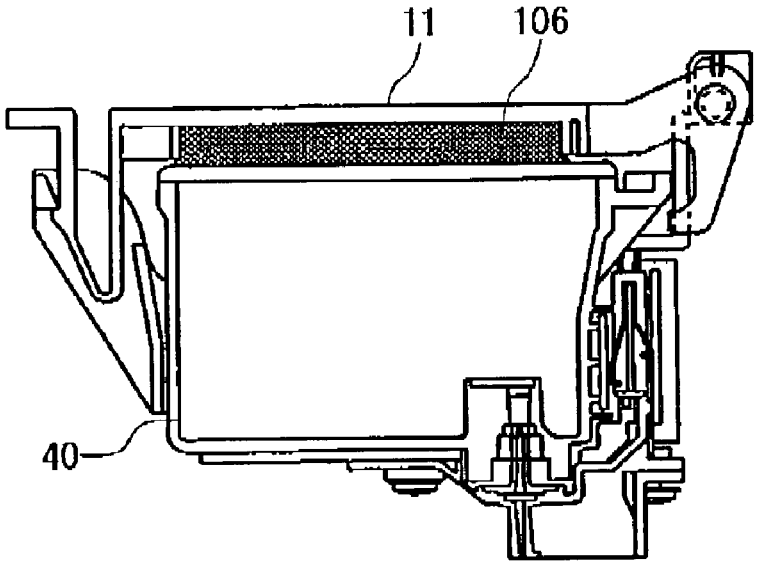
Figure 13:
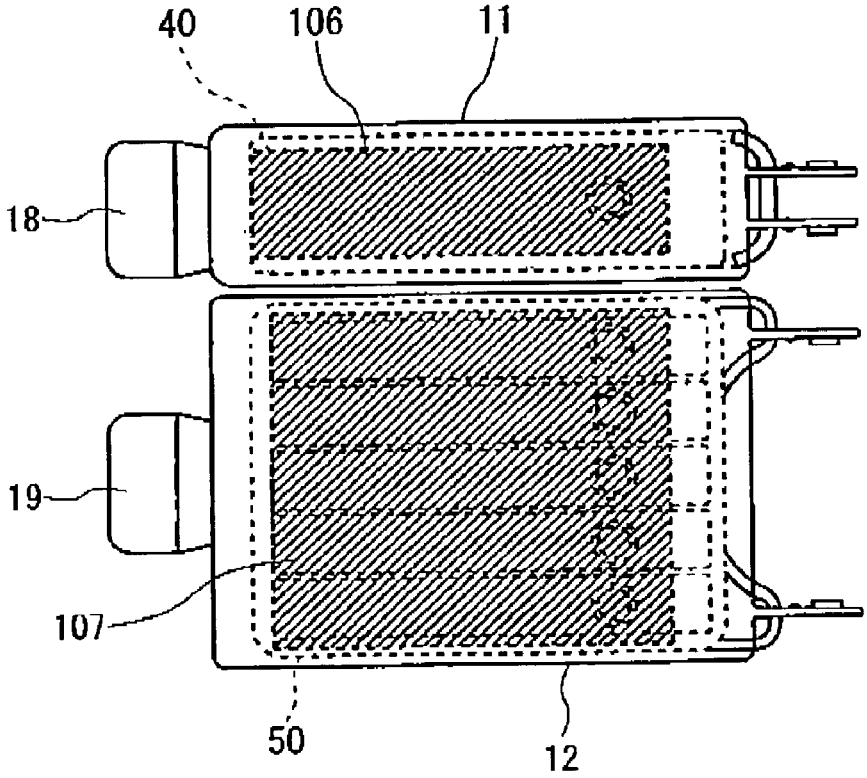

As shown in FIG. 13, when elastic members 106 and 107 in size covering the approximately overall face are mounted, the cartridges 40 and 50 can be more securely held by large frictional force. In this case, it is desirable that thickness and elastic modules are selected so that pressure on the side of the ink supply port is larger than that in the other area.

Figure 14:
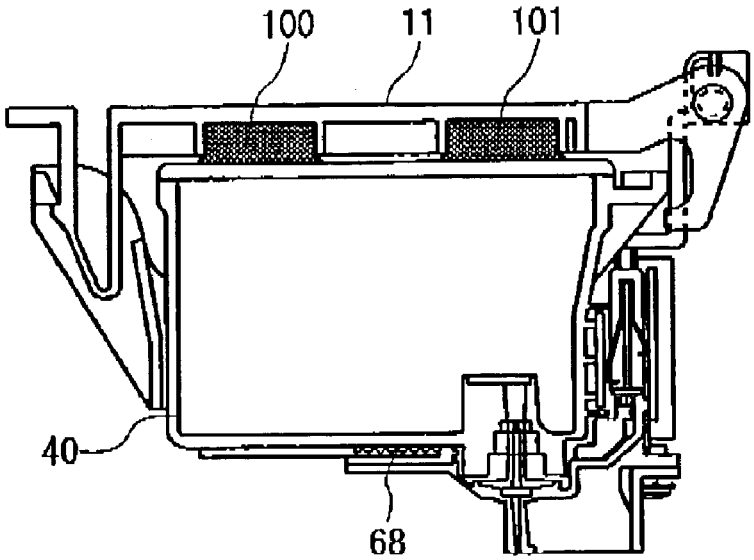
Figure 14:
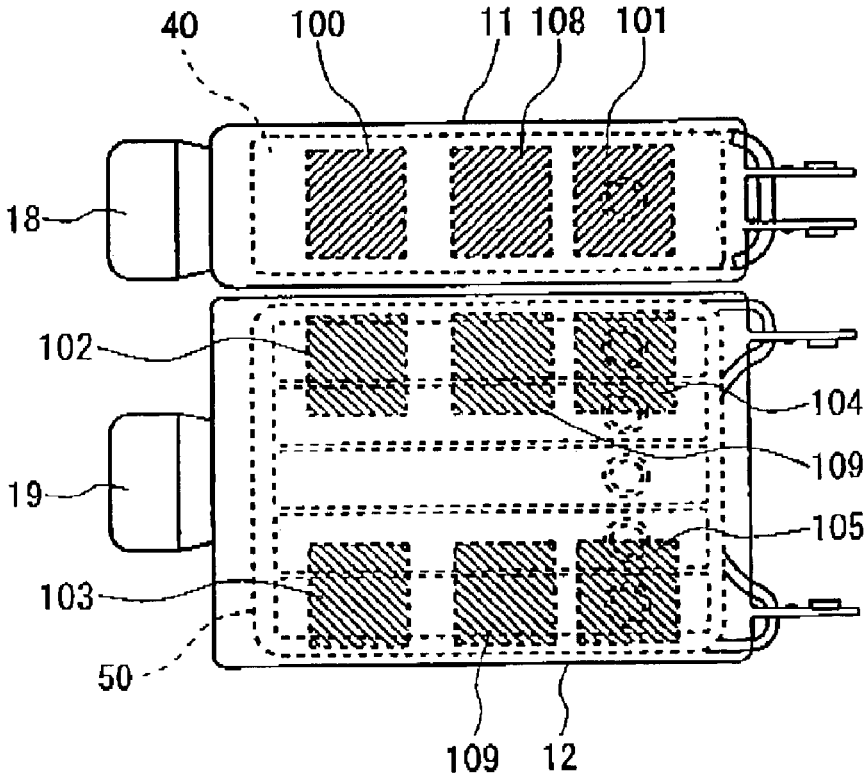

Further, as shown in FIG. 14, if elastic members 108 and 109 similar to the elastic members elastically pressing the upper surface are laid approximately in the center of the bottom of the holder 4, airtight capability between the ink supply port 44 or 54 and the ink supply needle 6 or 7 of the ink cartridge 40 or 50 can be maintained independent of vibration and shock.

Figure 15:
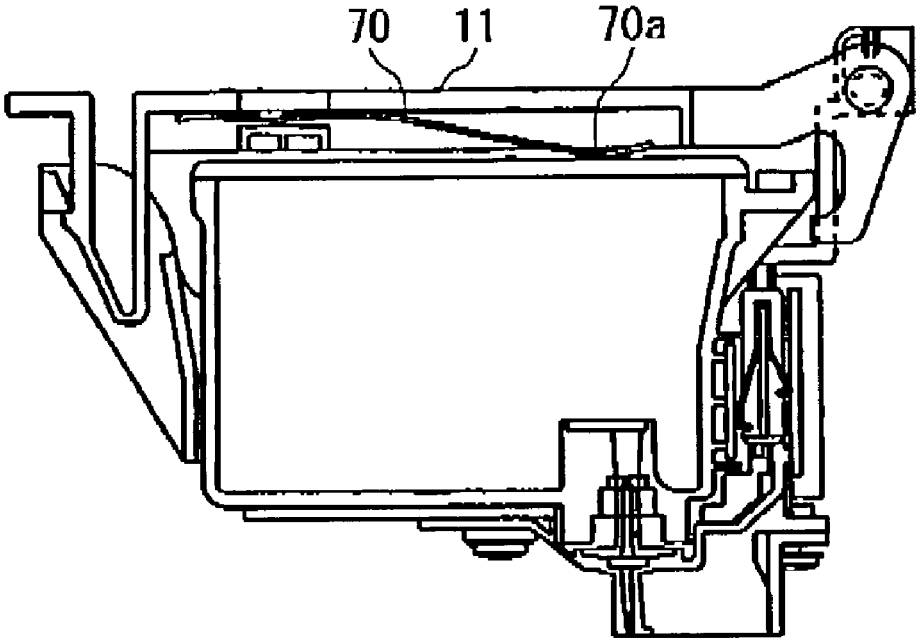
FIG. 15 is a sectional view showing another embodiment of the present invention in a state in which the ink cartridge is installed.

Further, even if at least one plate spring 70 protruded at least on the side of the ink supply port is fixed to the side of a free end at the back of the lever 11 as shown in FIG. 15, the ink cartridge 40 can be fixed in the holder. In this case, it is more effective that non-slip and others are stuck on the side of the free end 70*a* of the plate spring 70 or on the cover of the ink cartridge.

Figure 16:
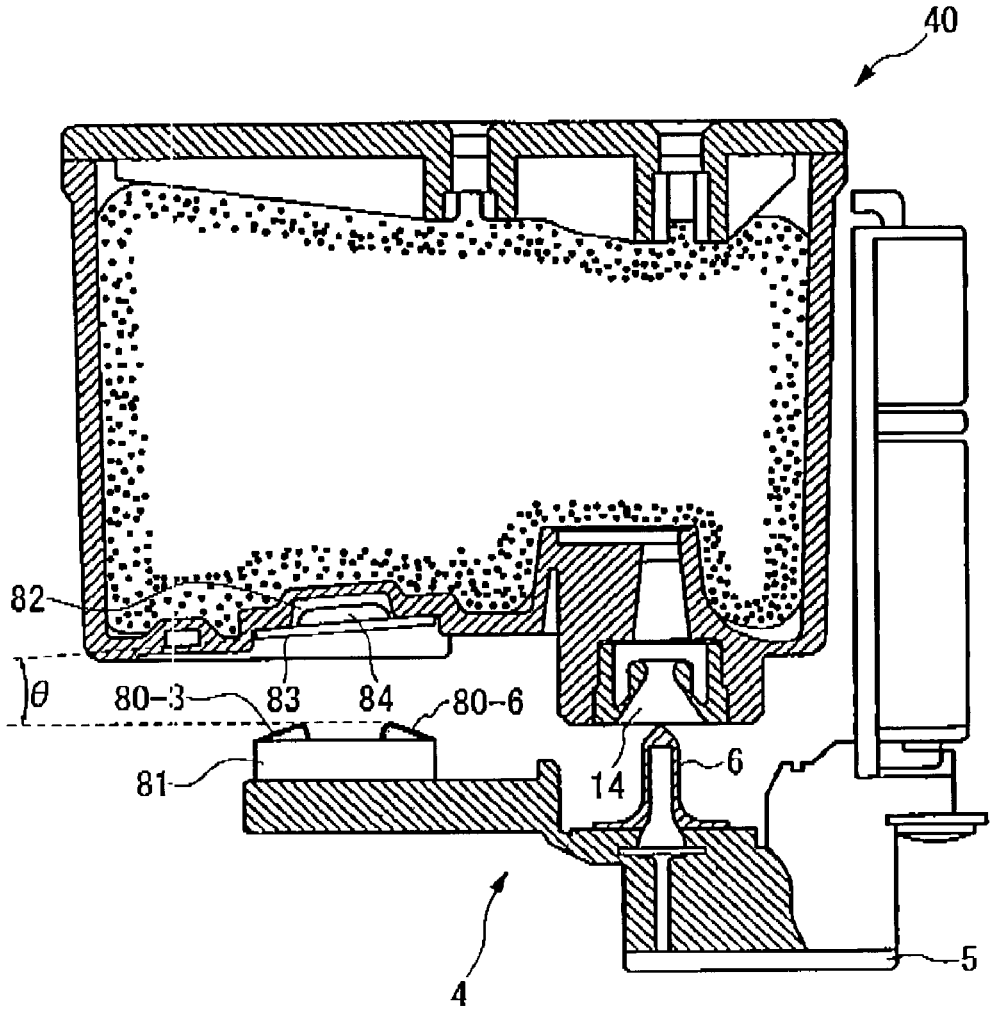
FIG. 16 is a sectional view showing another embodiment of the head holder and the ink cartridge respectively in the above printing apparatus, FIGS. 17(*a*) and 17(*b*) are respectively a plan and a side view showing an embodiment of the contact provided to the above head holder, and FIGS. 18(*a*) to 18(*c*) are respectively a front view, a side view and a rear view showing a contact board mounted on the above ink cartridge.
Figure 17:
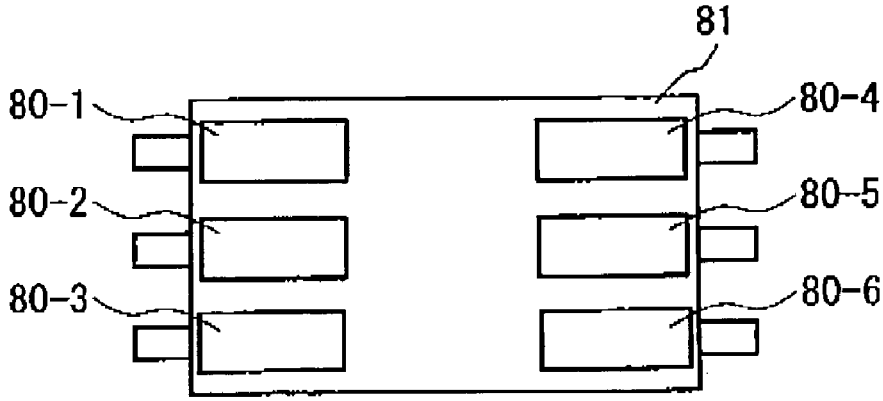
Figure 17:
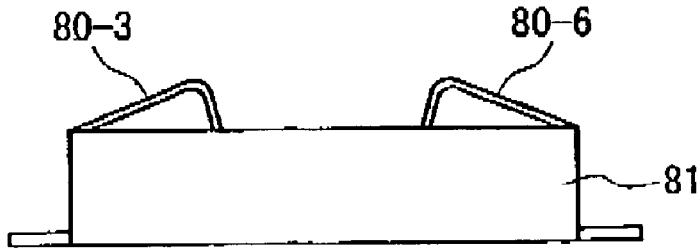

FIG. 16 shows an embodiment in case a circuit board is arranged at the bottom in the vicinity of an ink supply port or an ink cartridge, an ink supply needle 6 communicating with a print head 5 is planted at the bottom of a carriage and a board 81 on which elastically transformable contacts 80-1, 80-2, . . . 80-6 formed by a spring are formed is provided in a position possibly adjacent to the ink supply needle 6 as shown in FIGS. 17(*a*) and 17(*b*).

In the meantime, an ink supply port 14 which can be fitted to the ink supply needle 6 is provided at the bottom of an ink cartridge 40, a concave portion 82 is formed in a position possibly close to the ink supply port 14 and in a position opposite to the contact board 81 and a circuit board 83 is fixed diagonally so that the circuit board has an angle θ with each vertex of the contacts 80-1 to 80-6. It is preferable that the circuit board 83 may be diagonal with respect to a plane perpendicular to a direction in which the ink cartridge is mounted on the printing apparatus.

Figure 18:
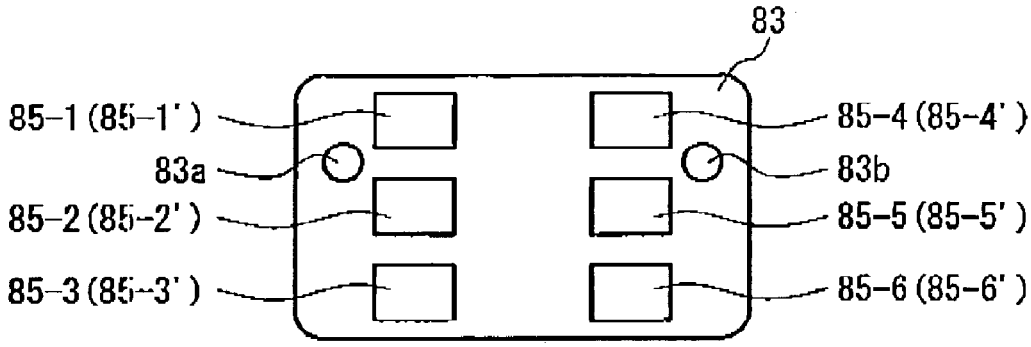
Figure 18:
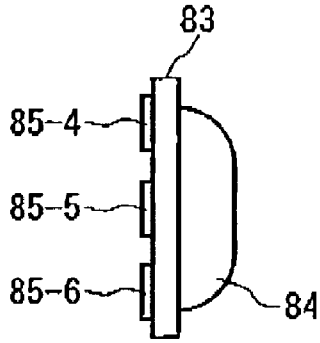
Figure 18:
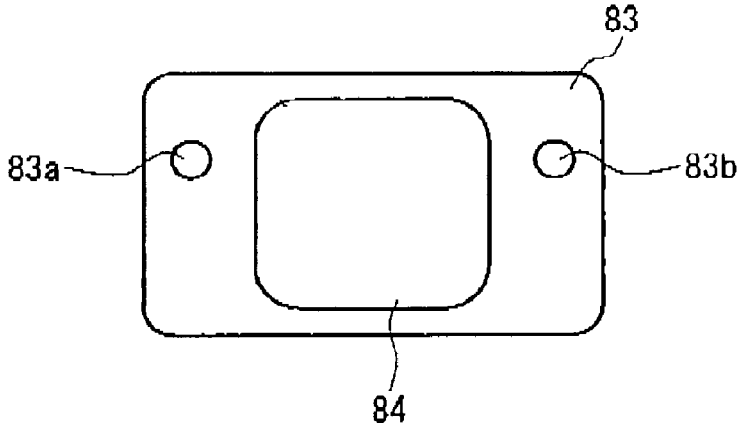

Through holes 83*a* and 83*b* for a positioning are formed on the circuit board 83 as shown in FIG. 18(*a*), semiconductor storage means 84 is mounted on the surface on the side of an ink housing chamber, that is, at the back as shown in FIGS. 18(*b*) and 18(*c*) and contacts 85-1, 85-2, . . . 85-6 connected to the data input terminal and the driving power supply terminal of the semiconductor storage means 84 for acquiring conduction to the contacts 80-1 to 80-6 on the side of the carriage, are formed on the side of the exposed surface.

As the semiconductor storage means 84 is mounted at the rear surface of the circuit board 83 as described above, the degree of freedom in arranging the contacts is enhanced. The surface and the rear of the circuit board 83 can be effectively utilized and electrodes to be the contacts 85-1, 85-2, . . . 85-6 can be formed in area to the extent that the reliability of connection can be secured. A molding agent can be readily applied to the surface on which the semiconductor storage means 84 is formed without considering whether application precision is high or not to prevent from adhering to the contacts 85-1, 85-2, . . . 85-6 and the manufacturing process can be simplified.

Further, because the semiconductor storage means 84 is mounted on the cartridge with the status hidden by the circuit board 83, a user can be prevented from touching to the storage means unintentionally, liquid such as ink can be prevented from adhering to the storage means, and electrostatic destruction and an accident caused by a short circuit can be also prevented.

The semiconductor storage means 84 is connected to control means not shown of the printing apparatus via the contacts 85-1, 85-2, . . . 85-6 and the contacts 80-1 to 80-6, data stored in the semiconductor storage means is read and data such as the quantity of ink consumed by printing operation is written to the means.

In another arrangement, the circuit board 83 may be diagonal with respect to a direction in which the ink cartridge 40 is mounted on the printing apparatus.

Figure 19:
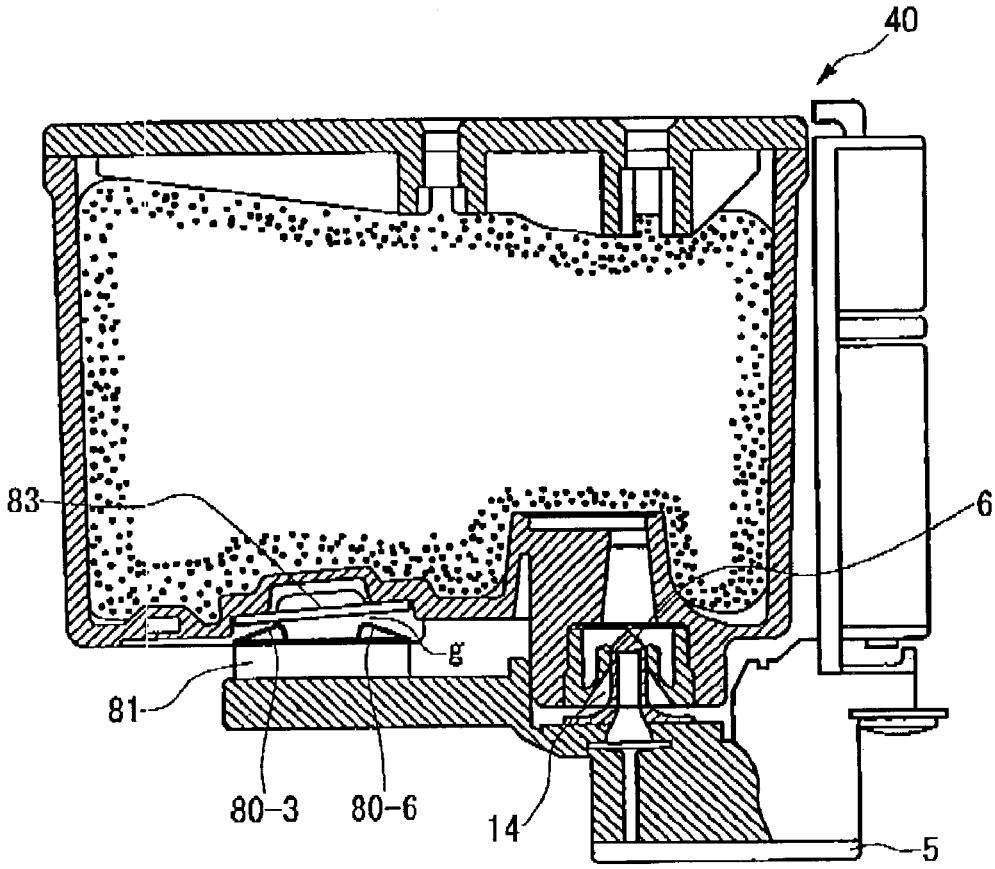
FIG. 19 is a sectional view showing first conduction in a process for inserting the ink cartridge, and FIG. 20(*a*) is a plan showing the other embodiment of the contact mounted on the above ink cartridge and FIG. 20(*b*) shows a state in which ink adheres.

In this embodiment, when the ink cartridge 40 reaches the vicinity of the bottom of the carriage in case the ink cartridge 40 is installed, the ink supply needle 6 enters the ink supply port 14 as shown in FIG. 19, forms a passage, the contacts 80-1 to 80-3 near one side of the circuit board 83 having an angle θ with a horizontal plane first come in contact with the contacts 85-1 to 85-3 and conduction is acquired.

When the cartridge 40 further is further lowered, the contacts 80-4 to 80-6 near the other side of the circuit board 83 come into contact with the contacts 85-4 to 85-6 and all contacts become conduction.

Therefore, power is supplied to the semiconductor storage means 84 through the contacts 80-1 to 80-3 and the contacts 85-1 to 85-3 by which conduction is first acquired so as to initialize the semiconductor storage means 84. Data can be prevented from being lost by accessing to data stored in the semiconductor storage means 84 via the contacts 80-4 to 80-6 and the contacts 85-4 to 85-6 which become conduction after the above conduction is acquired.

In the meantime, when the ink cartridge 40 is pulled out from the carriage, termination processing can be executed by power still supplied by the contacts 80-1 to 80-3 and the contacts 85-1 to 85-3 and afterward, power can be turned off through the contacts 80-4 to 80-6 and the contacts 85-4 to 85-6 are first disconnected. When processing for the semiconductor storage means 84 finishes as described above, the ink supply needle 6 is pulled out from the ink supply port 14.

Figure 20:
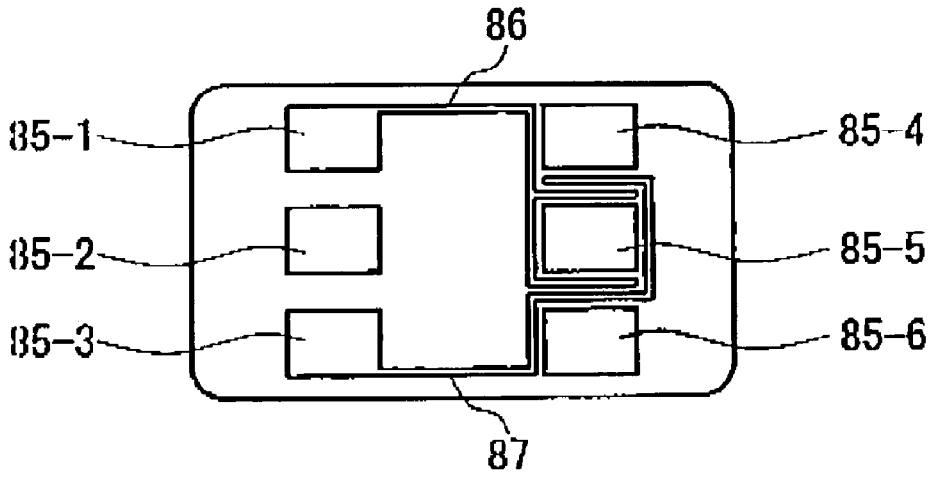
Figure 20:
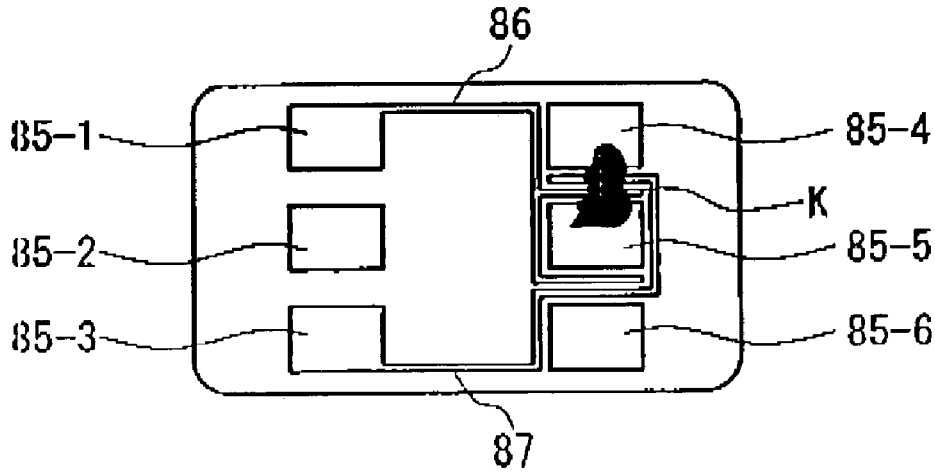

FIG. 20(*a*) shows the other embodiment of contacts 85-1 to 85-5 formed in an ink cartridge 40. Conductive patterns 86 and 87 are formed between a column of contacts 85-1 to 85-3 by which conduction is first acquired when the ink cartridge 40 is inserted and a column of contacts 85-4 to 85-5 by which conduction is afterward acquired.

For example, the contacts 85-1 and 85-3 are selected as a detection terminal and two of the contacts 85-4 to 85-5, that is, 85-4 and 85-5 may be selected as a power supply terminal.

In the arrangement described above, if ink K adheres across the terminals 85-4 and 85-5, serving as a power supply terminal as shown in FIG. 20(*b*), resistance between the terminals 85-4 and 85-5 is detected by the contacts 85-1 and 85-3, by which conduction is first acquired together with the contacts 80-1 and 80-3 of the holder 4 when the ink cartridge is inserted. If the detected resistance is lower than a predetermined value, the supply of power to 80-4 and 80-5 by which conduction is next acquired together with the power supply terminals 85-4 and 85-5 is stopped and an accident caused by a short circuit due to the adhesion of ink K can be precluded.

Figure 21:
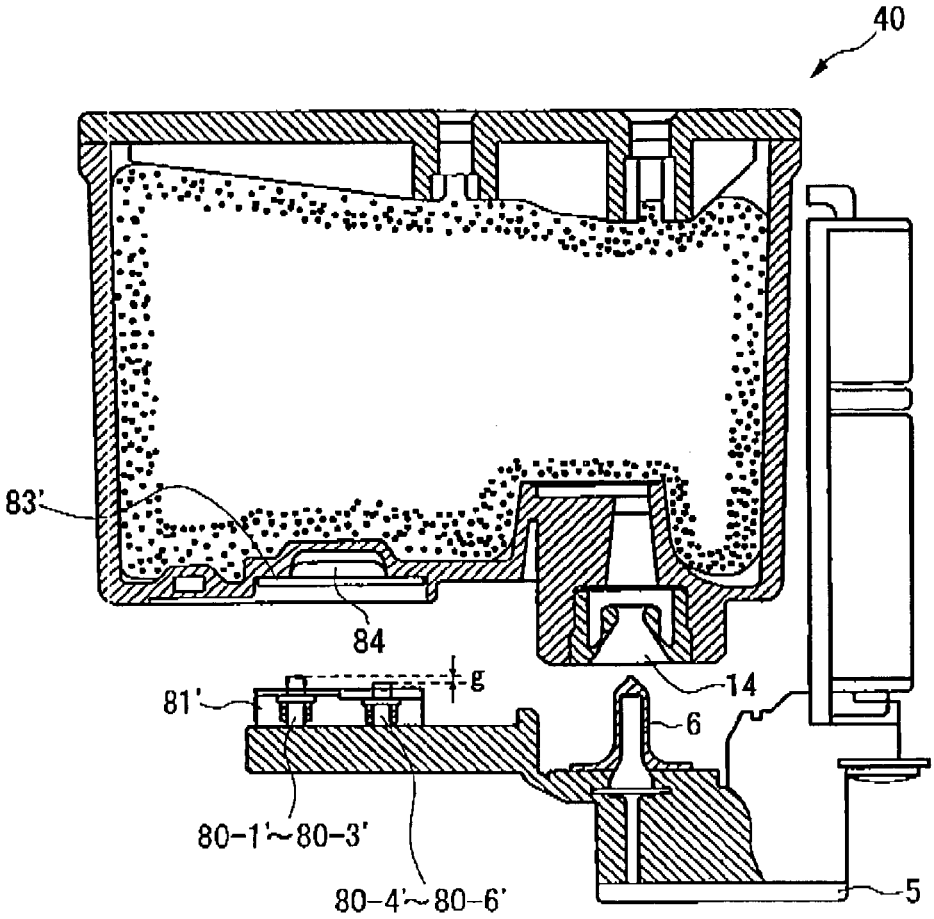
FIG. 21 is a sectional view showing the other embodiment of the head holder and the ink cartridge respectively in the printing apparatus according to the present invention.

FIG. 21 shows another preferred embodiment of the present invention in which a circuit board 83' on which contacts 85-1' to 85-6' formed such as to be secured horizontally at the bottom of an ink cartridge 40 while the circuit board is always pressed upward by a spring or the like. A board 81' on which two columns of contacts 80-1' to 80-3' and contacts 80-4' to 80-6' are formed is formed in such a manner that difference g in a level is made between the tip ends of the two columns is provided.

Figure 22:
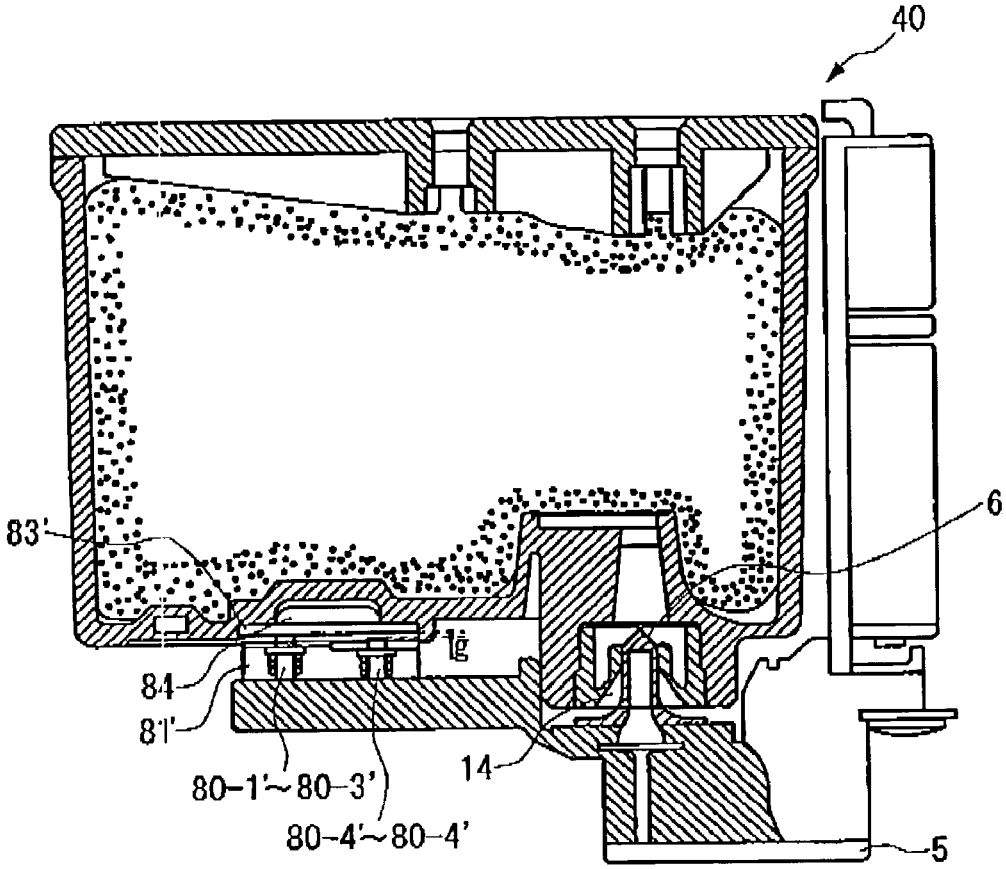
FIG. 22 is a sectional view showing first conduction in the process for inserting the ink cartridge in the above printing apparatus.

Also in this embodiment, as shown in FIG. 22, as the first column of contacts 85-1' to 85-3' and the contacts 80-1' and 80-3' first become conduction. Next, the second column of contacts 80-4' to 80-6' respectively short in a stroke come in contact with the contacts 85-4' and 85-6' and conduction is acquired, so that the similar action and effect to those in the above embodiments are produced.

Figure 23:
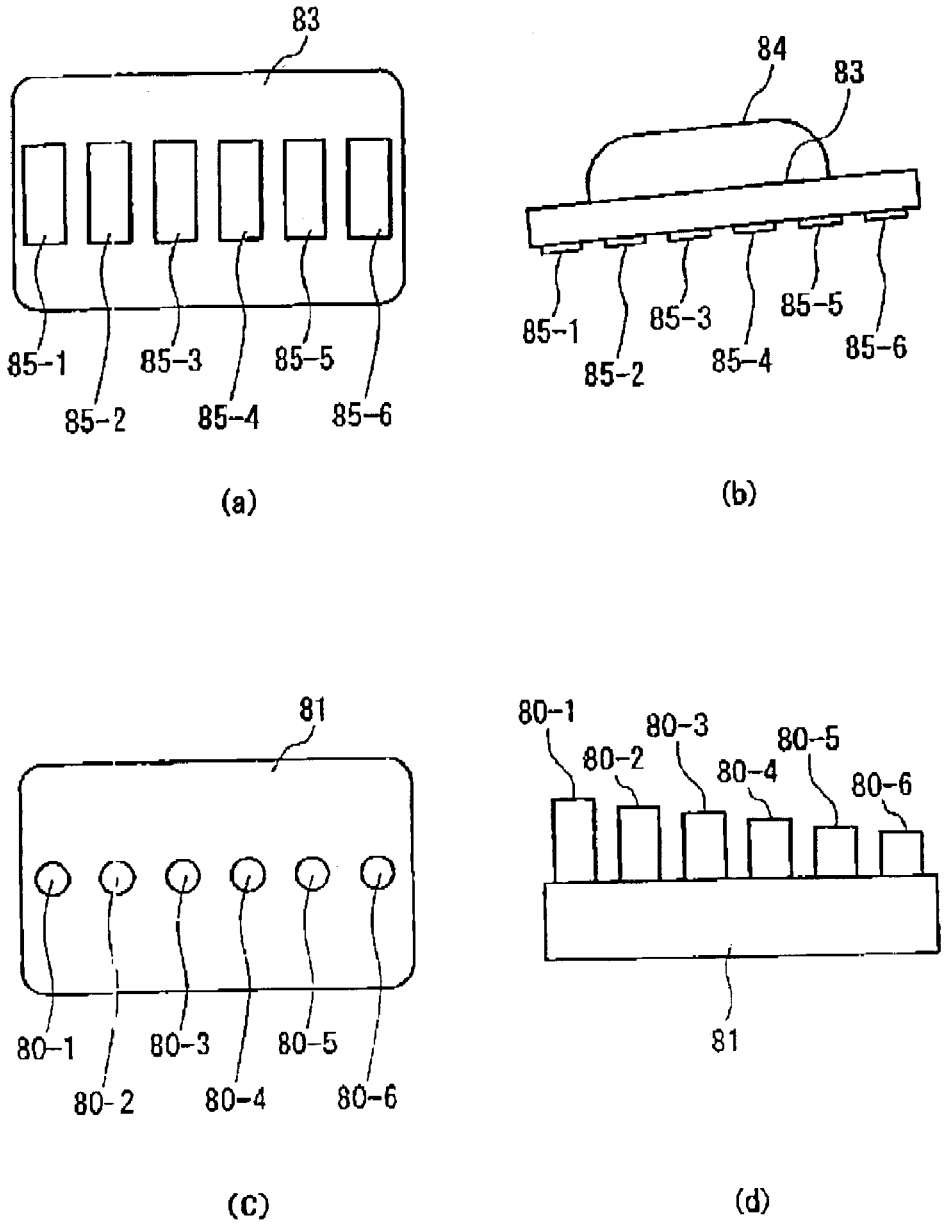
FIGS. 23(*a*) to 23(*d*) are respectively plans and side views showing the other embodiment of the present invention in relation to the arrangement of the contacts, and FIGS. 24(*a*) and 24(*b*) are respectively sectional views showing another embodiment of the mounting of the circuit board on the ink cartridge and a top view showing the structure of a mounting plate.

In the above embodiment, the contacts 80-1 to 80-6 and 85-1 to 85-6 are divided into plural columns and difference in time until conduction is acquired is provided between the columns. However, it is clear that the similar effect may be realized even if the contacts 80-1 to 80-6 and the contacts 85-1 to 85-6 are respectively arranged in one row as shown in FIGS. 23(*a*) and 23(*b*), and a board 83 on which the contacts 85-1 to 85-6 are formed is angled as shown in FIGS. 23(*c*) and 23(*d*) so that the conducting time becomes different between the contact 80-1 and 85-1 on one side and the contact 80-6 and 85-6 on the other side. Similarly, if the position of each end of the contacts 80-1 to 80-6 is designed to be differentiated, so that the same function may be achieved.

In the above embodiments, the mode according to which the ink cartridge is mounted on the carriage is described as an example. However, it is apparent that a similar effect may be obtained even if the present invention is applied to a printing apparatus of a type in which an ink cartridge is housed in a cartridge housing area of the apparatus body and is connected to a print head via an ink supply tube.

That is, contacts have only to be formed in required positions on the exposed face of the ink cartridge and the above contacts 85-1 to 85-6 have only to be formed in touchable positions opposite to the contacts of the ink cartridge when the ink cartridge is installed.

Figure 24:
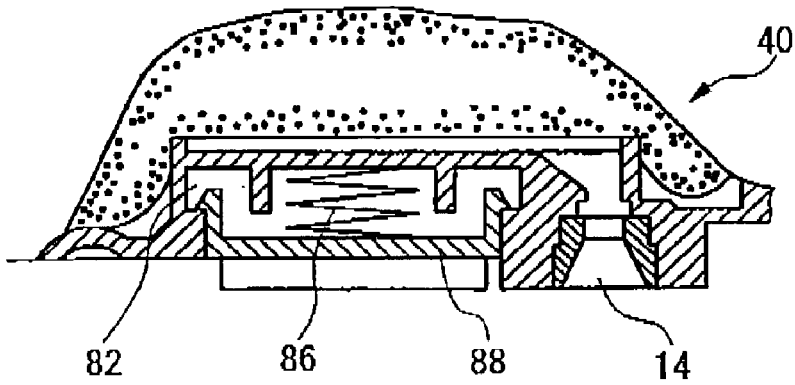
Figure 24:
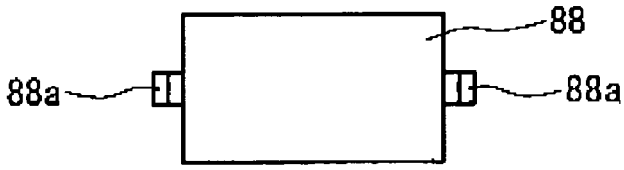
Figure 25:
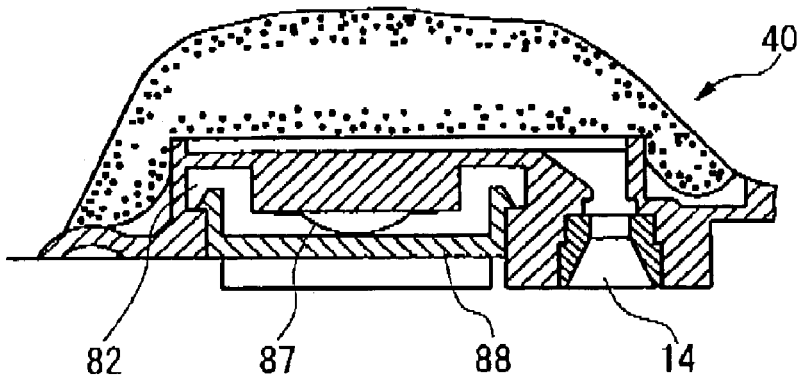
FIG. 25 is a sectional view showing another embodiment of the mounting of the circuit board on the ink cartridge.

In addition, the same effect may be accomplished even in an arrangement in which the board 83 is mounted at the bottom of the ink cartridge 40 via a mounting plate 88 having elastically transformable pawls 88*a* protruding therefrom at least at both ends on the open sides of the mounting plate, after inserting a coil spring 86 or an arcuate plate spring 87 into a concave portion as shown in FIGS. 24 and 25. Alternatively, the same effect may be obtained if the semiconductor storage means 84 is mounted on the mounting plate 88 thereby to form the contacts 85-1, 85-2, . . . 85-6. According to this arrangement, if merely a jig is prepared, the pawls 88*a* can be removed by the jig and the board 83 can be detached from the cartridge 40 in a factory while precluding unnecessary detachment by user.

Further, in the above embodiments, projections for positioning may be formed on the ink cartridge and the circuit board is positioned. However, the similar effect can be achieved in another arrangement in which a concave portion 93*a* is formed on a wall of an ink cartridge 90, a wall 93 adjacent to the bottom 92 on which an ink supply port 91 is formed, in this embodiment as shown in FIG. 26(*a*), a circuit board 83 is housed and fixed in the concave portion 93*a*.

Figure 26:
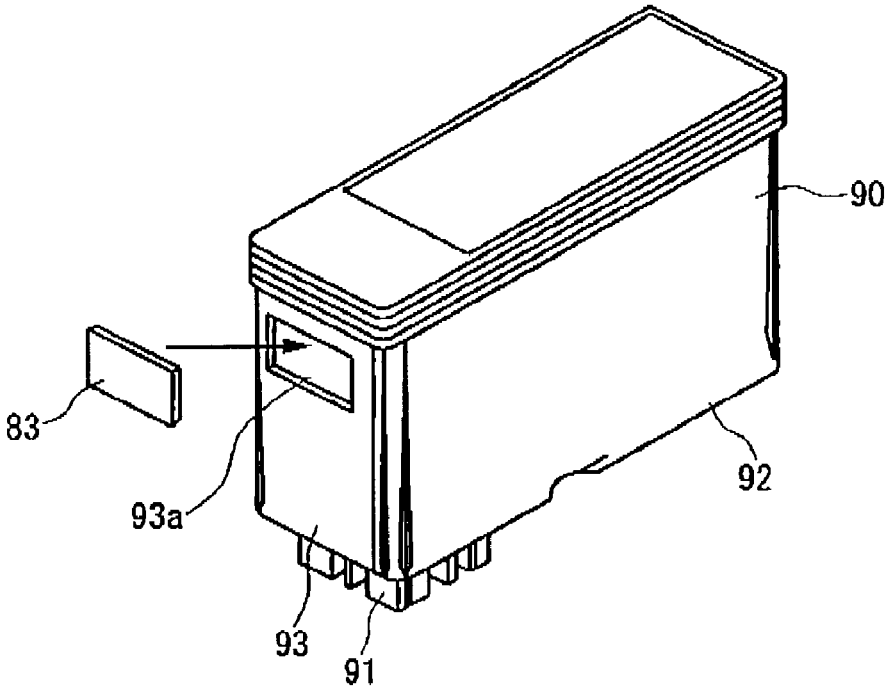
FIGS. 26(*a*) and 26(*b*) show the other embodiment of the mounting of the circuit board.
Figure 26:
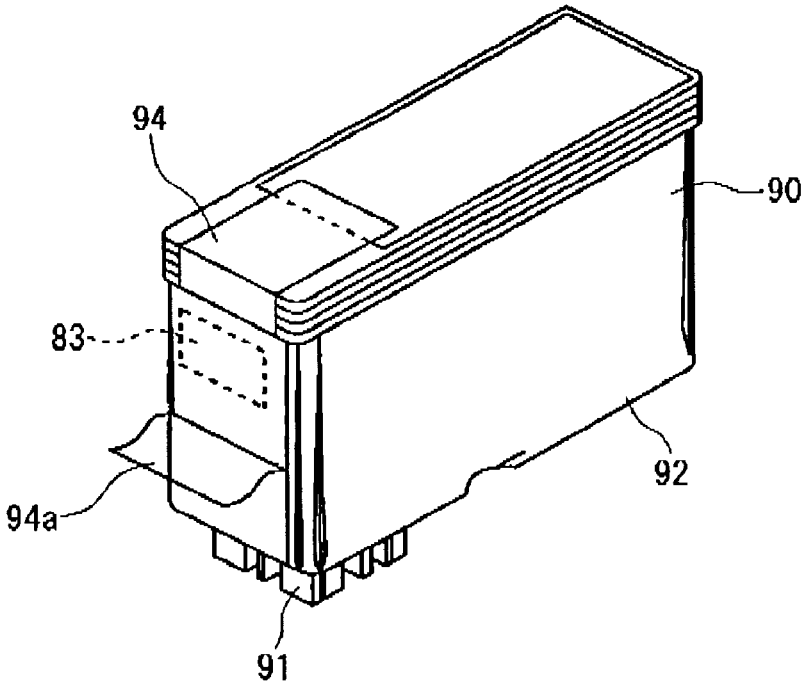

If necessary, a film 94 which can be peeled from one end 94*a* may be also applied as shown in FIG. 26(*b*) and may be also sealed till the start of use.

According to the present invention, as the ink supply needle is located near one side in a direction perpendicular to the direction of the reciprocation of the carriage, the circuit board is mounted on the wall in the vicinity of the side on which the ink supply port is formed of the ink cartridge, the plural contacts for connecting to external control means are formed on the exposed surface of the circuit board and the semiconductor storage means is accessed from the external control means via the contacts, the circuit board is located on the side of the ink supply port and the face on which the circuit board is fixed is moved along the ink supply needle. Therefore, even if there is play between the carriage and the cartridge, the cartridge is moved according to a locus defined by the ink supply needle and the ink supply port, the contacts are connected to the external control means in a defined order and data stored in the semiconductor storage means can be securely prevented from being lost by the application of signals in an unprepared order.

What is claimed is:

1. An ink cartridge for mounting on a carriage of an inkjet printing apparatus to supply ink to a printhead of the inkjet printing apparatus through an ink supply needle, comprising:

a plurality of external surfaces;

an ink supply port formed in one of said external surfaces that receives the ink supply needle;

a semiconductor memory located on or in the cartridge; and a plurality of electrodes for connecting to an external control means, the electrodes being positioned on another of said external surfaces and generally adjacent to said external surface having the ink supply port, the electrodes being provided in an upper row having a middle electrode arranged between a first end electrode and a second end electrode and a lower row having at opposite ends a third end electrode and a fourth end electrode, the end electrodes being arranged such that the first and the second end electrodes terminate closer, in the widthwise direction of the rows, to said middle electrode than do the third and the fourth end electrodes.

2. The ink cartridge according to claim 1, wherein, when the cartridge is mounted on the carriage in a direction generally perpendicular to the direction of the rows, electrical connections can be made to the end electrodes of the upper row without those electrical connections first having been made to the end electrodes of the lower row.

3. The ink cartridge according to claim 1, wherein, viewing the ink cartridge in a direction perpendicular to a plane of the electrodes, at least one of the rows is symmetrically disposed about a plane passing through a centerline of the ink supply port.

4. The ink cartridge according to claim 1, wherein said external surfaces are substantially rectangular and include a first external surface and a second external surface, and said electrodes are disposed on said second external surface, which is substantially perpendicular to said first external surface, said second external surface having a shorter width than the other surface.

5. The ink cartridge according to claim 1, wherein said memory is detachably mounted on one of said external surfaces.

6. The ink cartridge according to claim 1, wherein said memory is mounted on one of said external surfaces by a spring and a mounting plate.

7. The ink cartridge according to claim 1, wherein said memory and said electrodes are located on a substrate having a positioning member.

8. The ink cartridge according to claim 7, wherein said electrodes are arranged on one surface of said substrate and said memory is disposed on an other surface of said substrate.

9. The ink cartridge according to claim 1, wherein said electrodes are grouped into at least a first group and a second group.

10. The ink cartridge according to claim 1, wherein said electrodes come into engagement with an external control device at a time interval when the ink cartridge is mounted on the printing apparatus.

11. An ink cartridge for mounting on a carriage of an inkjet printing apparatus to supply ink to a printhead of the inkjet printing apparatus through an ink supply needle, comprising:

a plurality of external surfaces;

an ink supply port formed in one of said external surfaces that receives the ink supply needle;

a semiconductor memory located on or in the cartridge; and a plurality of electrodes for connecting to an external control means, the electrodes being positioned on a different said external surface than the ink supply port, and generally adjacent to said external surface having the ink supply port, the electrodes having contact portions which respectively touch contact forming members of the printing apparatus, the contact portions being provided in an upper row having a middle contact portion arranged between a first end contact portion and a second end contact portion and a lower row having at opposite ends a third end contact portion and a fourth end contact portion, the end contact portions being arranged such that the first and the second end contact portions terminate closer, in the widthwise direction of the rows, to said middle contact portion than do the third and the fourth end contact portions.

12. The ink cartridge according to claim 11, wherein, when the cartridge is mounted on the carriage in a direction generally perpendicular to the direction of the rows, electrical connections can be made to the end contact portions of the upper row without those electrical connections first having been made to the end contact portions of the lower row.

13. The ink cartridge according to claim 11, wherein, viewing the ink cartridge in a direction perpendicular to a plane of the electrodes, at least one of the rows is symmetrically disposed about a plane passing through a centerline of the ink supply port.

14. The ink cartridge according to claim 11, wherein said external surfaces are substantially rectangular and include a first external surface and a second external surface, and said electrodes are disposed in a plane parallel to said second external surface, which said second external surface is substantially perpendicular to said first external surface, said second external surface having a shorter width than said first external surface.

15. The ink cartridge according to claim 11, wherein said memory is detachably mounted on one of said external surfaces.

16. The ink cartridge according to claim 11, wherein said memory is mounted on one of said external surfaces by a spring and a mounting plate.

17. The ink cartridge according to claim 11, wherein said memory and said electrodes are located on a substrate having a positioning structure.

18. The ink cartridge according to claim 17, wherein said electrodes are arranged on one surface of said substrate and said memory is disposed on an other surface of said substrate.

19. The ink cartridge according to claim 11, wherein said contact portions are grouped into at least a first group and a second group.

20. The ink cartridge according to claim 11, wherein said contact portions come into engagement with an external control device at a time interval when the ink cartridge is mounted on the printing apparatus.

21. An ink cartridge for mounting on a carriage of an inkjet printing apparatus to supply ink to a printhead of the inkjet printing apparatus through an ink supply needle, comprising:

a plurality of external surfaces;

an ink supply port formed in one of said external surfaces that receives the ink supply needle, the ink supply port having an axis;

a semiconductor memory located on or in the cartridge; and a plurality of electrodes, at least one of the electrodes for connecting said memory to an external control means, the electrodes being positioned on another of said external surfaces and generally adjacent to said external surface having the ink supply port, the electrodes being provided in an upper row having a middle electrode having a portion disposed on a line that is parallel to the axis of the ink supply port, and a respective separate end electrode on both sides thereof and a lower row having at each end a respective separate end electrode, such that each of the end electrodes of the upper row terminates closer, in a widthwise direction of the rows, to the line than does the respective end electrode of the lower row.

22. The ink cartridge according to claim 21, wherein, when the cartridge is mounted on the carriage in a direction generally perpendicular to the direction of the rows, electrical connections can be made to the end electrodes of the upper row without those electrical connections first having been made to the end electrodes of the lower row.

23. The ink cartridge according to claim 21, wherein, viewing the ink cartridge in a direction perpendicular to a plane of the electrodes, at least one of the rows is symmetrically disposed about a plane passing through a centerline of the ink supply port.

24. The ink cartridge according to claim 21, wherein said external surfaces are substantially rectangular and include a first external surface and a second external surface, and said electrodes are disposed on said second external surface, which is substantially perpendicular to said first external surface, said second external surface having a shorter width than the other surface.

25. The ink cartridge according to claim 21, wherein said memory is detachably mounted on one of said external surfaces.

26. The ink cartridge according to claim 21, wherein said memory is mounted on one of said external surfaces by a spring and a mounting plate.

27. The ink cartridge according to claim 21, wherein said memory and said electrodes are located on a substrate having a positioning member.

28. The ink cartridge according to claim 27, wherein said electrodes are arranged on one surface of said substrate and said memory is disposed on an other surface of said substrate.

29. The ink cartridge according to claim 21, wherein said electrodes are grouped into at least a first group and a second group.

30. The ink cartridge according to claim 21, wherein said electrodes come into engagement with an external control device at a time interval when the ink cartridge is mounted on the printing apparatus.

31. An ink cartridge for mounting on a carriage of an inkjet printing apparatus to supply ink to a printhead of the inkjet printing apparatus through an ink supply needle, comprising:

a plurality of external surfaces;

an ink supply port formed in one of said external surfaces that receives the ink supply needle, the ink supply needle having an axis;

a semiconductor memory located on or in the cartridge; and a plurality of electrodes, at least one of the electrodes for connecting said memory to an external control means, the electrodes being positioned on a different said external surface than the ink supply port and generally adjacent to said external surface having the ink supply port, the electrodes having contact portions which respectively touch contact forming members of the printing apparatus, the contact portions being provided in an upper row having a middle contact portion, the middle contact portion being disposed on a line that is parallel to the axis of the ink supply port, and a respective separate end contact portion on both sides thereof and a lower row having at each end a respective separate end contact portion, such that each of the end contact portions of the upper row terminates closer, in a widthwise direction of the rows, to the line than does the respective end contact portion of the lower row.

32. The ink cartridge according to claim 31, wherein, when the cartridge is mounted on the carriage in a direction generally perpendicular to the direction of the rows, electrical connections can be made to the end contact portions of the upper row without those electrical connections first having been made to the end contact portions of the lower row.

33. The ink cartridge according to claim 31, wherein, viewing the ink cartridge in a direction perpendicular to a plane of the electrodes, at least one of the rows is symmetrically disposed about a plane passing through a centerline of the ink supply port.

34. The ink cartridge according to claim 31, wherein said external surfaces are substantially rectangular and include a first external surface and a second external surface, and said electrodes are disposed in a plane parallel to said second external surface, which said second external surface is substantially perpendicular to said first external surface, said second external surface having a shorter width than said first external surface.

35. The ink cartridge according to claim 31, wherein said memory is detachably mounted on one of said external surfaces.

36. The ink cartridge according to claim 31, wherein said memory is mounted on one of said external surfaces by a spring and a mounting plate.

37. The ink cartridge according to claim 31, wherein said memory and said electrodes are located on a substrate having a positioning structure.

38. The ink cartridge according to claim 37, wherein said electrodes are arranged on one surface of said substrate and said memory is disposed on an other surface of said substrate.

39. The ink cartridge according to claim 31, wherein said contact portions are grouped into at least a first group and a second group.

40. The ink cartridge according to claim 31, wherein said contact portions come into engagement with an external control device at a time interval when the ink cartridge is mounted on the printing apparatus.

41. An ink cartridge for mounting on a carriage of an inkjet printing apparatus to supply ink to a printhead of the inkjet printing apparatus through an ink supply needle, comprising:

a plurality of external surfaces;

an ink supply port formed in one of said external surfaces that receives the ink supply needle;

a semiconductor memory located on or in the cartridge; and a plurality of electrodes, at least one of the electrodes for connecting said memory to an external control means, the electrodes being positioned on another of said external surfaces and generally adjacent to said external surface having the ink supply port, the electrodes being provided in an upper row having a middle electrode intersecting a plane passing through an axis of the ink supply port and arranged between a first end electrode and a second end electrode and a lower row having at each end a third end electrode and a fourth end electrode, the end electrodes being arranged such that the first and the second end electrodes terminate closer, in the widthwise direction of the rows, to said plane intersecting said middle electrode than do the third and the fourth end electrodes.

42. The ink cartridge according to claim 41, wherein, when the cartridge is mounted on the carriage in a direction generally perpendicular to the direction of the rows, electrical connections can be made to the end electrodes of the upper row without those electrical connections first having been made to the end electrodes of the lower row.

43. The ink cartridge according to claim 41, wherein, viewing the ink cartridge in a direction perpendicular to a plane of the electrodes, at least one of the rows is symmetrically disposed about a plane passing through a centerline of the ink supply port.

44. The ink cartridge according to claim 41, wherein said external surfaces are substantially rectangular and include a first external surface and a second external surface, and said electrodes are disposed on said second external surface, which is substantially perpendicular to said first external surface, said second external surface having a shorter width than the other surface.

45. The ink cartridge according to claim 41, wherein said memory is detachably mounted on one of said external surfaces.

46. The ink cartridge according to claim 41, wherein said memory is mounted on one of said external surfaces by a spring and a mounting plate.

47. The ink cartridge according to claim 41, wherein said memory and said electrodes are located on a substrate having a positioning member.

48. The ink cartridge according to claim 47, wherein said electrodes are arranged on one surface of said substrate and said memory is disposed on an other surface of said substrate.

49. The ink cartridge according to claim 41, wherein said electrodes are grouped into at least a first group and a second group.

50. The ink cartridge according to claim 41, wherein said electrodes come into engagement with an external control device at a time interval when the ink cartridge is mounted on the printing apparatus.

51. An ink cartridge for mounting on a carriage of an inkjet printing apparatus to supply ink to a printhead of the inkjet printing apparatus through an ink supply needle, comprising:

a plurality of external surfaces;

an ink supply port formed in one of said external surfaces that receives the ink supply needle;

a semiconductor memory located on or in the cartridge; and a plurality of electrodes, at least one of the electrodes for connecting said memory to an external control means, the electrodes being positioned on a different said external surface than the ink supply port, and generally adjacent to said external surface having the ink supply port, the electrodes having contact portions which respectively touch contact forming members of the printing apparatus, the contact portions being provided in an upper row having a middle contact portion intersecting a plane passing through an axis of the ink supply port and arranged between a first end contact portion and a second end contact portion and a lower row having at each end a third end contact portion and a fourth end contact portion, the end contact portions being arranged such that the first and the second end contact portions terminate closer, in the widthwise direction of the rows, to said plane intersecting said middle contact portion than do the third and the fourth end contact portions.

52. The ink cartridge according to claim 51, wherein, when the cartridge is mounted on the carriage in a direction generally perpendicular to the direction of the rows, electrical connections can be made to the end electrodes of the upper row without those electrical connections first having been made to the end electrodes of the lower row.

53. The ink cartridge according to claim 51, wherein, viewing the ink cartridge in a direction perpendicular to a plane of the electrodes, at least one of the rows is symmetrically disposed about a plane passing through a centerline of the ink supply port.

54. The ink cartridge according to claim 51, wherein said external surfaces are substantially rectangular and include a first external surface and a second external surface, and said electrodes are disposed on said second external surface, which is substantially perpendicular to said first external surface, said second external surface having a shorter width than the other surface.

55. The ink cartridge according to claim 51, wherein said memory is detachably mounted on one of said external surfaces.

56. The ink cartridge according to claim 51, wherein said memory is mounted on one of said external surfaces by a spring and a mounting plate.

57. The ink cartridge according to claim 51, wherein said memory and said electrodes are located on a substrate having a positioning member.

58. The ink cartridge according to claim 57, wherein said electrodes are arranged on one surface of said substrate and said memory is disposed on an other surface of said substrate.

59. The ink cartridge according to claim 51, wherein said electrodes are grouped into at least a first group and a second group.

60. The ink cartridge according to claim 51, wherein said electrodes come into engagement with an external control device at a time interval when the ink cartridge is mounted on the printing apparatus.

* * * * *